US010888496B2

(12) United States Patent
Garfield et al.

(10) Patent No.: US 10,888,496 B2
(45) Date of Patent: Jan. 12, 2021

(54) MEDICAMENT VIAL ASSEMBLY

(71) Applicant: J&J Solutions, Inc., Coralville, IA (US)

(72) Inventors: Jared Garfield, North Liberty, IA (US); Dana Schramm, Woodbury, MN (US); Andy Ahlberg, Inver Grove Heights, MN (US)

(73) Assignee: CORVIDA MEDICAL, INC., Coralville, IA (US)

( * ) Notice: Subject to any disclaimer, the term of this patent is extended or adjusted under 35 U.S.C. 154(b) by 386 days.

(21) Appl. No.: 15/761,255

(22) PCT Filed: Sep. 16, 2016

(86) PCT No.: PCT/US2016/052167
§ 371 (c)(1),
(2) Date: Mar. 19, 2018

(87) PCT Pub. No.: WO2017/049107
PCT Pub. Date: Mar. 23, 2017

(65) Prior Publication Data

US 2018/0263848 A1 Sep. 20, 2018

Related U.S. Application Data

(60) Provisional application No. 62/220,058, filed on Sep. 17, 2015.

(51) Int. Cl.
*A61J 1/20* (2006.01)
*A61J 1/14* (2006.01)

(52) U.S. Cl.
CPC ..... *A61J 1/2048* (2015.05); *A61J 1/1406* (2013.01); *A61J 1/2051* (2015.05); *A61J 1/2055* (2015.05);
(Continued)

(58) Field of Classification Search
CPC ..... A61J 1/201; A61J 1/2055; A61J 1/2096; A61J 1/2051; A61J 1/1406; A61J 1/2072;
(Continued)

(56) References Cited

U.S. PATENT DOCUMENTS 2,530,230 A 11/1950 Cozzoli
3,270,996 A 9/1966 Churchill et al.
(Continued)

FOREIGN PATENT DOCUMENTS

CN 202825572 U 3/2013
CN 103007371 A 4/2013
(Continued)

OTHER PUBLICATIONS

Urologix, Inc.—Medical Professionals: Targis3 Technology (a date prior to the filing of the present application) http://www.urologix.com/medical/technology.html (3 total pages).
(Continued)

*Primary Examiner* — Ophelia A Hawthorne
*Assistant Examiner* — Alessandro R Del Priore
(74) *Attorney, Agent, or Firm* — Carter, DeLuca & Farrell LLP; Francesco Sardone, Esq.

(57) ABSTRACT

The present disclosure relates to medical vials pre-attached with a vial adapter assembly for the transfer of gases/liquids/fluid or other substances to/from medical vials.

11 Claims, 24 Drawing Sheets

(52) U.S. Cl.
CPC ..... *A61J 1/2096* (2013.01); *A61J 1/201* (2015.05); *A61J 1/2072* (2015.05)

(58) Field of Classification Search
CPC ..... A61J 1/20; A61J 1/2065; A61J 1/2048; A61J 1/2003; A61J 1/1425; A61J 1/2089; A61M 39/1011; A61M 2039/1072; A61M 2039/1077; A61M 39/10; A61M 2039/1027; A61M 2039/263; A61M 5/19; Y10S 604/905; F16L 37/2445
See application file for complete search history.

(56) References Cited

U.S. PATENT DOCUMENTS 3,706,305 A 12/1972 Berger et al.
4,180,070 A 12/1979 Genese
4,201,208 A 5/1980 Cambio, Jr.
4,576,211 A 3/1986 Valentini et al.
4,579,380 A 4/1986 Zaremsky et al.
4,673,404 A 6/1987 Gustaysson
4,692,068 A 9/1987 Hanrot et al.
4,752,292 A 6/1988 Lopez et al.
5,100,394 A 3/1992 Dudar et al.
5,135,489 A 8/1992 Jepson et al.
5,158,554 A 10/1992 Jepson et al.
5,167,648 A 12/1992 Jepson et al.
5,188,620 A 2/1993 Jepson et al.
5,211,638 A 5/1993 Dudar et al.
5,312,377 A 5/1994 Dalton
5,314,466 A 5/1994 Stern et al.
5,344,441 A 9/1994 Gronauer
5,370,678 A 12/1994 Edwards et al.
5,405,340 A 4/1995 Fageol et al.
5,409,453 A 4/1995 Lundquist et al.
5,431,201 A 7/1995 Torchia et al.
5,437,650 A 8/1995 Larkin et al.
5,445,630 A 8/1995 Richmond
5,470,327 A 11/1995 Helgren et al.
5,507,733 A 4/1996 Larkin et al.
5,520,666 A 5/1996 Choudhury et al.
5,545,152 A 8/1996 Funderburk et al.
5,549,566 A 8/1996 Elias et al.
5,580,351 A 12/1996 Helgren et al.
5,658,260 A 8/1997 Desecki et al.
5,685,842 A 11/1997 Drivas
5,685,866 A 11/1997 Lopez
5,702,374 A 12/1997 Johnson
5,776,176 A 7/1998 Rudie
5,785,682 A 7/1998 Grabenkort
5,785,692 A 7/1998 Attermeier et al.
5,797,897 A 8/1998 Jepson et al.
5,800,486 A 9/1998 Thome et al.
5,807,345 A 9/1998 Grabenkort
5,810,768 A 9/1998 Lopez
5,861,021 A 1/1999 Thome et al.
5,871,500 A 2/1999 Jepson et al.
5,891,129 A 4/1999 Daubert et al.
5,899,888 A 5/1999 Jepson et al.
5,924,584 A 7/1999 Hellstrom et al.
5,954,104 A 9/1999 Daubert et al.
5,954,708 A 9/1999 Lopez et al.
5,957,898 A 9/1999 Jepson et al.
5,964,785 A 10/1999 Desecki et al.
6,063,068 A 5/2000 Fowles et al.
6,083,194 A 7/2000 Lopez
6,090,091 A 7/2000 Fowles et al.
6,113,068 A 9/2000 Ryan
6,139,534 A 10/2000 Niedospial, Jr. et al.
6,161,049 A 12/2000 Rudie et al.
6,171,287 B1 1/2001 Lynn et al.
6,193,697 B1 2/2001 Jepson et al.
6,213,996 B1 4/2001 Jepson et al.
6,221,065 B1 4/2001 Davis
6,245,048 B1 6/2001 Fangrow, Jr. et al.
6,261,266 B1 7/2001 Jepson et al.
6,261,282 B1 7/2001 Jepson et al.
6,302,289 B1 10/2001 Andersson et al.
6,344,033 B1 2/2002 Jepson et al.
6,382,442 B1 5/2002 Thibault et al.
6,387,074 B1 5/2002 Horppu et al.
6,394,983 B1 5/2002 Mayoral et al.
6,409,708 B1 6/2002 Wessman
6,428,520 B1 8/2002 Lopez et al.
6,447,498 B1 9/2002 Jepson et al.
6,506,189 B1 1/2003 Rittman, III et al.
6,522,930 B1 2/2003 Schaer et al.
6,524,295 B2 2/2003 Daubert et al.
6,569,125 B2 5/2003 Jepson et al.
6,577,903 B1 6/2003 Cronin et al.
6,595,964 B2 7/2003 Finley et al.
6,599,273 B1 7/2003 Lopez
6,605,076 B1 8/2003 Jepson et al.
6,605,576 B2 8/2003 Lee
6,635,043 B2 10/2003 Daubert et al.
6,635,044 B2 10/2003 Lopez
6,635,055 B1 10/2003 Cronin
6,647,935 B2 11/2003 Aoyama et al.
6,660,527 B2 12/2003 Stroup
6,669,681 B2 12/2003 Jepson et al.
6,684,918 B1 2/2004 Thilly et al.
6,695,817 B1 2/2004 Fangrow, Jr.
6,706,040 B2 3/2004 Mahon et al.
D488,867 S 4/2004 Chau
6,715,520 B2 4/2004 Andreasson et al.
6,752,154 B2 6/2004 Fogarty et al.
6,871,838 B2 3/2005 Raines et al.
6,874,522 B2 4/2005 Anderson et al.
6,875,205 B2 4/2005 Leinsing
6,887,235 B2 5/2005 O'Connor et al.
6,915,823 B2 7/2005 Osborne et al.
6,939,350 B2 9/2005 Phan
7,025,389 B2 4/2006 Cuschieri et al.
7,040,598 B2 5/2006 Raybuck
7,044,441 B2 5/2006 Doyle
7,100,891 B2 9/2006 Doyle
7,114,701 B2 10/2006 Peppel
7,118,590 B1 10/2006 Cronin
7,128,739 B2 10/2006 Prakash et al.
7,175,615 B2 2/2007 Hanly et al.
7,197,363 B2 3/2007 Prakash et al.
7,223,259 B2 5/2007 Marshall et al.
7,244,249 B2 7/2007 Leinsing et al.
7,306,198 B2 12/2007 Doyle
7,306,584 B2 12/2007 Wessman et al.
7,311,703 B2 12/2007 Turovskiy et al.
7,314,061 B2 1/2008 Peppel
7,316,669 B2 1/2008 Ranalletta
7,358,505 B2 4/2008 Woodworth et al.
7,396,051 B2 7/2008 Baldwin et al.
7,425,209 B2 9/2008 Fowles et al.
7,470,258 B2 12/2008 Barker et al.
7,497,848 B2 3/2009 Leinsing et al.
7,497,849 B2 3/2009 Fangrow, Jr.
7,503,908 B2 3/2009 Bartholomew
7,510,545 B2 3/2009 Peppel
7,563,253 B2 7/2009 Tanner et al.
7,569,036 B2 8/2009 Domkowski et al.
7,569,043 B2 8/2009 Fangrow
7,591,449 B2 9/2009 Raines et al.
7,615,035 B2 11/2009 Peppel
7,645,271 B2 1/2010 Fangrow
7,645,274 B2 1/2010 Whitley
7,651,481 B2 1/2010 Raybuck
7,670,326 B2 3/2010 Shemesh
7,713,247 B2 5/2010 Lopez
7,717,883 B2 5/2010 Lopez
7,717,884 B2 5/2010 Lopez
7,717,886 B2 5/2010 Lopez
7,743,799 B2 6/2010 Mosler et al.
7,744,581 B2 6/2010 Wallen et al.
7,753,085 B2 7/2010 Tribble et al.
7,753,338 B2 7/2010 Desecki
7,758,560 B2 7/2010 Connell et al.

(56) References Cited

U.S. PATENT DOCUMENTS

| | | | | |
|---|---|---|---|---|
| 7,762,524 | B2 | 7/2010 | Cawthon et al. | |
| 7,763,013 | B2 | 7/2010 | Baldwin et al. | |
| 7,763,199 | B2 | 7/2010 | Fangrow, Jr. | |
| 7,766,304 | B2 | 8/2010 | Phillips | |
| 7,766,897 | B2 | 8/2010 | Ramsey et al. | |
| 7,824,393 | B2 | 11/2010 | Fangrow | |
| 7,900,659 | B2 | 3/2011 | Whitley et al. | |
| 8,043,864 | B2 | 10/2011 | Stroup | |
| 8,119,419 | B2 | 2/2012 | Stroup | |
| 8,122,923 | B2 | 2/2012 | Kraus et al. | |
| 8,251,346 | B2 | 8/2012 | Stroup | |
| 8,287,513 | B2 | 10/2012 | Ellstrom et al. | |
| 8,414,554 | B2 | 4/2013 | Garfield et al. | |
| 8,414,555 | B2 | 4/2013 | Garfield et al. | |
| 8,414,556 | B2 | 4/2013 | Garfield et al. | |
| 8,469,940 | B2 | 6/2013 | Garfield et al. | |
| 8,545,475 | B2 | 10/2013 | Wallen | |
| 8,894,627 | B2 | 11/2014 | Garfield et al. | |
| 8,913,645 | B2 | 12/2014 | Sabourdy et al. | |
| 9,039,047 | B2 | 5/2015 | Imai | |
| 9,082,979 | B2 | 7/2015 | Malek et al. | |
| 9,107,809 | B2 | 8/2015 | Garfield et al. | |
| 9,186,494 | B2 | 11/2015 | Fangrow | |
| 9,220,661 | B2 | 12/2015 | Garfield et al. | |
| 9,351,906 | B2 | 5/2016 | Garfield et al. | |
| 9,358,182 | B2 | 6/2016 | Garfield et al. | |
| 9,364,396 | B2 | 6/2016 | Garfield et al. | |
| 9,370,466 | B2 | 6/2016 | Garfield et al. | |
| 9,381,137 | B2 | 7/2016 | Garfield et al. | |
| 9,877,895 | B2 | 1/2018 | Garfield et al. | |
| 10,258,541 | B2 * | 4/2019 | Cheng | A61J 1/2096 |
| 2002/0115981 | A1 | 8/2002 | Wessman | |
| 2002/0177819 | A1 | 11/2002 | Barker et al. | |
| 2003/0070726 | A1 * | 4/2003 | Andreasson | A61J 1/2096 141/329 |
| 2003/0187420 | A1 | 10/2003 | Akerlund et al. | |
| 2003/0191445 | A1 | 10/2003 | Wallen et al. | |
| 2004/0124389 | A1 | 7/2004 | Phillips | |
| 2004/0144668 | A1 | 7/2004 | Marshall et al. | |
| 2004/0215147 | A1 | 10/2004 | Wessman et al. | |
| 2006/0097371 | A1 | 5/2006 | Kawasaki et al. | |
| 2006/0106360 | A1 | 5/2006 | Wong | |
| 2006/0129109 | A1 | 6/2006 | Shaw et al. | |
| 2007/0015233 | A1 | 1/2007 | Brancia | |
| 2007/0079894 | A1 | 4/2007 | Kraus et al. | |
| 2007/0088315 | A1 | 4/2007 | Haindl | |
| 2007/0101772 | A1 | 5/2007 | Duncan et al. | |
| 2007/0177819 | A1 | 8/2007 | Ma et al. | |
| 2008/0097371 | A1 | 4/2008 | Shemesh | |
| 2008/0103455 | A1 | 5/2008 | Domkowski et al. | |
| 2008/0103485 | A1 | 5/2008 | Kruger | |
| 2008/0114328 | A1 | 5/2008 | Doherty et al. | |
| 2008/0132854 | A1 | 6/2008 | Sharp | |
| 2008/0142388 | A1 | 6/2008 | Whitley et al. | |
| 2008/0172024 | A1 | 7/2008 | Yow | |
| 2008/0223484 | A1 | 9/2008 | Horpou | |
| 2008/0249479 | A1 | 10/2008 | Zinger et al. | |
| 2008/0249498 | A1 | 10/2008 | Fangrow | |
| 2008/0262465 | A1 | 10/2008 | Zinger et al. | |
| 2008/0264450 | A1 | 10/2008 | Baldwin et al. | |
| 2008/0287920 | A1 | 11/2008 | Fangrow et al. | |
| 2008/0318456 | A1 | 12/2008 | Yow et al. | |
| 2009/0069783 | A1 | 3/2009 | Ellstrom et al. | |
| 2009/0216212 | A1 | 8/2009 | Fangrow, Jr. | |
| 2009/0243281 | A1 | 10/2009 | Seifert et al. | |
| 2009/0270832 | A1 | 10/2009 | Vancaillie et al. | |
| 2009/0326506 | A1 | 12/2009 | Hasegawa et al. | |
| 2010/0004602 | A1 | 1/2010 | Nord et al. | |
| 2010/0004618 | A1 | 1/2010 | Rondeau et al. | |
| 2010/0004619 | A1 | 1/2010 | Rondeau et al. | |
| 2010/0004634 | A1 | 1/2010 | Whitley | |
| 2010/0036330 | A1 | 2/2010 | Plishka et al. | |
| 2010/0049160 | A1 | 2/2010 | Jepson et al. | |
| 2010/0055668 | A1 | 3/2010 | Stroup | |
| 2010/0106129 | A1 | 4/2010 | Goeckner et al. | |
| 2010/0108681 | A1 | 5/2010 | Jepson et al. | |
| 2010/0147402 | A1 | 6/2010 | Tornqvist | |
| 2010/0152669 | A1 | 6/2010 | Rosenquist | |
| 2010/0160889 | A1 | 6/2010 | Smith et al. | |
| 2010/0217226 | A1 | 8/2010 | Shemesh | |
| 2010/0218846 | A1 | 9/2010 | Kriheli | |
| 2010/0241088 | A1 | 9/2010 | Ranalletta et al. | |
| 2010/0249745 | A1 | 9/2010 | Ellstrom | |
| 2011/0004185 | A1 | 1/2011 | Hasegawa et al. | |
| 2011/0015580 | A1 | 1/2011 | Stroup | |
| 2011/0049866 | A1 | 3/2011 | Trombley, III et al. | |
| 2011/0112501 | A1 | 5/2011 | Garfield et al. | |
| 2011/0266477 | A1 | 11/2011 | Stroup | |
| 2012/0048676 | A1 | 3/2012 | Giribona et al. | |
| 2012/0157914 | A1 | 6/2012 | Stroup | |
| 2012/0325365 | A1 | 12/2012 | Strangis | |
| 2013/0000780 | A1 | 1/2013 | Garfield et al. | |
| 2013/0066293 | A1 * | 3/2013 | Garfield | A61J 1/2051 604/408 |
| 2014/0155894 | A1 | 6/2014 | Dorawa et al. | |
| 2015/0068640 | A1 | 3/2015 | Garfield et al. | |
| 2015/0209235 | A1 | 7/2015 | Garfield et al. | |
| 2016/0243007 | A1 | 8/2016 | Constantine et al. | |
| 2016/0250102 | A1 | 9/2016 | Garfield et al. | |
| 2016/0271017 | A1 * | 9/2016 | Weir | A61J 1/2055 |
| 2018/0008784 | A1 | 1/2018 | Olson et al. | |
| 2018/0147118 | A1 | 5/2018 | Garfield et al. | |

FOREIGN PATENT DOCUMENTS

| | | | |
|---|---|---|---|
| CN | 104029025 | A | 9/2014 |
| EP | 0050466 | A1 | 4/1982 |
| EP | 0452220 | A1 | 10/1991 |
| FR | 2944302 | A1 | 10/2010 |
| FR | 2959878 | A1 | 11/2011 |
| FR | 2959879 | A1 | 11/2011 |
| JP | 08182742 | | 7/1996 |
| JP | 2002126094 | A | 5/2002 |
| WO | 9929415 | A1 | 6/1999 |
| WO | 03088806 | A2 | 10/2003 |
| WO | 2005002492 | A1 | 1/2005 |
| WO | 2007101772 | A1 | 9/2007 |
| WO | 2007120641 | A2 | 10/2007 |
| WO | 2008136720 | A1 | 11/2008 |
| WO | 2009035384 | A1 | 3/2009 |
| WO | 2011124780 | A2 | 10/2011 |
| WO | 2014007694 | A1 | 1/2014 |
| WO | 2017049107 | A1 | 3/2017 |
| WO | 2017066406 | A1 | 4/2017 |

OTHER PUBLICATIONS

Chou, C.K. (1995). "Radiofrequency Hyperthermia in Cancer Therapy," Biologic Effects of Nonionizing Electromagnetic Fields; Chapter 94; CRC Press, Inc.; pp. 1424-1428.

International Search Report & Written Opinion of Int'l Appln. PCT/US2016/052167 dated Dec. 7, 2016.

* cited by examiner

MEDICAMENT VIAL ASSEMBLY

CROSS-REFERENCE TO RELATED APPLICATION

The present application is a 35 U.S.C § 371 National Phase Filing claiming the benefit of and priority to International Application No. PCT/US2016/052167, filed on Sep. 16, 2016, which claims the benefit of and priority to The present application claims the benefit of and priority to U.S. Provisional Application Ser. No. 62/220,058, filed on Sep. 17, 2015, the entire content of which is incorporated herein by reference.

BACKGROUND

1. Technical Field

The present disclosure relates generally to medical vial assemblies, and more particularly, to medical vials pre-attached with a vial adapter assembly for the transfer of gases/liquids/fluid or other substances to/from medical vials.

2. Background of Related Art

In one instance, hazardous medicines are frequently applied in the treatment of certain diseases, in particular, for example, in the treatment of cancer. Cytotoxic drugs have generally been used to kill cancer cells. However, the use of cytotoxic drugs, in the treatment of cancer cells, presents specific dangers to all cells, both in the patient and in healthcare providers. Although the exposure to a health care provider is normally very small for each cytotoxic drug dose administration, evidence suggests that chronic, low-dose exposure can produce significant health problems. Accordingly, a system that allows the safe handling of hazardous drugs while significantly reducing and/or eliminating the exposure to providers would be of great benefit.

Drugs are typically supplied in glass or plastic vials that are capped with a gas impermeable liquid seal or stopper. In some instances, the vial contents are a solid powder, such that a liquid needs to be injected for mixing (e.g., reconstitution). The injection of additional contents (e.g., liquid) into the vial produces an increased pressure which stresses the seal or stopper. Although the vial is intended to be sealed to liquid and gases, drug molecules in vapor phase can leak or pass around the sides of the stopper or through the stopper as the injection needle is withdrawn, thus presenting a hazard to the provider or clinician.

Accordingly, with the potential for aerosol leakage, leakage/spraying upon needle withdrawal, or spills, a means with which to prevent the accidental vapor phase drug egress is required.

Thus, a need exists for new components and systems capable of more efficiently transferring gases/fluids/liquids or other substances to/from a vial without leaking or spilling and without exposure of the liquids to substances outside the closed system. As such, healthcare personnel may more safely use and handle fluid substances including potentially hazardous liquids and the like.

SUMMARY

The present disclosure relates to medical vials pre-attached with a vial adapter assembly for the transfer of gases/liquids/fluid or other substances to/from medical vials.

According to an aspect of the present disclosure, a vial adapter assembly for a closed fluid transfer system is provided. The vial adapter assembly includes a vial adapter, and a vial collar.

The vial adapter includes a base defining an inner annular rim and an outer annular rim and a cavity therebetween; an annular stem extending from the base and defining an opening having a plurality of fingers extending around the opening thereof, wherein each finger defines a proximal recess and a distal recess formed therein; a cover supported on the outer annular rim, wherein an expansion chamber is defined within the cover and the base; and an adapter support situated within the cavity of the base.

The adapter support includes a male stem extending in a first direction from the base, the male stem selectively connectable to and insertable into an open distal end of a syringe adapter, the male stem defining a lumen extending therethrough; a seal extending across the lumen of the male stem; and a spike extending in a second direction from the inner annular rim and into the opening of the annular stem, wherein the spike includes a first lumen being in fluid communication with the lumen of the male stem, and wherein the spike includes a second lumen being in fluid communication with the expansion chamber.

The adapter support further includes a bladder extending between the base and the cover.

The vial collar includes an annular body configured and dimensioned for sliding receipt within the annular stem of the vial adapter; at least one tab projecting from an outer surface of the annular body and being configured for selective receipt in distal recess and proximal recess of a respective finger of vial adapter; and at least one retainer projecting from an inner surface of the annular body.

The vial adapter assembly may include a first position where the vial collar is extended relative to the annular stem, and a second position where the vial collar is retracted relative to the annular stem.

When the vial adapter assembly is in the first position, the at least one tab of the vial collar may be disposed within the distal recess of a respective finger of the plurality of fingers of the annular stem. When the vial adapter assembly is in the second position, the at least one tab of the vial collar may be disposed within the proximal recess of a respective finger of the plurality of fingers of the annular stem. When the vial adapter assembly is in the second position, the at least one tab of the vial collar may be disposed within the proximal recess of a respective finger of the plurality of fingers of the annular stem.

The plurality of fingers of the annular stem may be resilient.

The spike of the vial adapter may extend towards the annular body of the vial collar.

The plurality of fingers of the annular stem of the vial adapter may include two pair of diametrically opposed fingers. The at least one tab of the vial collar may include two pair of diametrically opposed tabs. The at least one retainer of the vial adapter may include two pair of diametrically opposed retainers.

The spike of the vial adapter may be configured to penetrate a stopper of a medical vial upon an actuation of the vial adapter assembly from the first position to the second position.

According to another aspect of the present disclosure, a medical vial assembly is provided and includes a medical vial including a neck defining an opening into the vial, and a stopper disposed within the neck and closing the opening of the vial; and a vial adapter assembly connected to the neck of the medical vial.

The vial adapter assembly includes a base defining an inner annular rim and an outer annular rim and a cavity therebetween; an annular stem extending from the base and defining an opening having a plurality of fingers extending around the opening thereof, wherein each finger defines a proximal recess and a distal recess formed therein; a cover supported on the outer annular rim, wherein an expansion chamber is defined within the cover and the base; and an adapter support situated within the cavity of the base.

The adapter support includes a male stem extending in a first direction from the base, the male stem selectively connectable to and insertable into an open distal end of a syringe adapter, the male stem defining a lumen extending therethrough; a seal extending across the lumen of the male stem; and a spike extending in a second direction from the inner annular rim and into the opening of the annular stem, wherein the spike includes a first lumen being in fluid communication with the lumen of the male stem, and wherein the spike includes a second lumen being in fluid communication with the expansion chamber.

The adapter support further includes a bladder extending between the base and the cover.

The medical vial assembly further includes a vial collar connected to the neck of the medical vial. The vial collar includes an annular body configured and dimensioned for sliding receipt within the annular stem of the vial adapter, and at least partially surrounding the neck of the medical vial; at least one tab projecting from an outer surface of the annular body and being configured for selective receipt in distal recess and proximal recess of a respective finger of vial adapter; and at least one retainer projecting from an inner surface of the annular body, wherein each retainer is snap-fit connected to the neck of the medical vial.

The vial adapter assembly may include a first position where the vial collar is extended relative to the annular stem, and a second position where the vial collar is retracted relative to the annular stem. When the vial adapter assembly is in the first position, the at least one tab of the vial collar may be disposed within the distal recess of a respective finger of the plurality of fingers of the annular stem. When the vial adapter assembly is in the second position, the at least one tab of the vial collar may be disposed within the proximal recess of a respective finger of the plurality of fingers of the annular stem. When the vial adapter assembly is in the second position, the spike of the vial adapter assembly may penetrate the stopper of the medical vial.

The plurality of fingers of the annular stem of the vial adapter assembly may be resilient.

A tip of the spike of the vial adapter may extend beyond the stopper of the medical vial when the vial adapter assembly is in the second position.

According to yet another aspect of the present disclosure, a vial adapter assembly for a closed fluid transfer system is provided and includes a vial adapter. The vial adapter includes a base defining an inner annular rim and an outer annular rim and a cavity therebetween; and an annular stem extending from the base and defining an opening. The annular stem includes a plurality of fingers extending around the opening thereof, wherein each finger terminates in a proximal-most retainer; and at least one distal-most retainer projecting radially inwardly from an inner surface of the annular stem.

The vial adapter further includes a cover supported on the outer annular rim, wherein an expansion chamber is defined within the cover and the base; and an adapter support situated within the cavity of the base. The adapter support includes a male stem extending in a first direction from the base, the male stem selectively connectable to and insertable into an open distal end of a syringe adapter, the male stem defining a lumen extending therethrough; a seal extending across the lumen of the male stem; and a spike extending in a second direction from the inner annular rim and into the opening of the annular stem, wherein the spike includes a first lumen being in fluid communication with the lumen of the male stem, and wherein the spike includes a second lumen being in fluid communication with the expansion chamber.

The vial adapter additionally includes a bladder extending between the base and the cover.

Each proximal-most retainer of the vial adapter may be resilient. Each distal-most retainer of the vial adapter may be resilient. The distal-most retainers may be in axial registration with the spike. Each distal-most retainer of the vial adapter may extend distally and radially inwardly. Each distal-most retainer of the vial adapter may include a shoulder located distal of a tip of the spike.

The spike of the vial adapter may extend towards the plurality of fingers. The plurality of fingers of the vial adapter may include two pair of diametrically opposed fingers. The at least one distal-most retainer may include two pair of diametrically opposed retainers.

The spike of the vial adapter may be configured to penetrate a stopper of a medical vial upon an insertion of a neck of the medical vial distally from the proximal-most retainers into engagement with the shoulder of the at least one distal-most retainer.

According to still another embodiment of the present disclosure, a medical vial assembly is provided and includes a medical vial and a vial adapter. The medical vial includes a neck defining an opening into the vial, and a stopper disposed within the neck and closing the opening of the vial.

The vial adapter includes a base defining an inner annular rim and an outer annular rim and a cavity therebetween; an annular stem extending from the base and defining an opening configured to receive the neck of the medical vial therein, the annular stem includes: a plurality of fingers extending around the opening thereof, wherein each finger terminates in a proximal-most retainer; and at least one distal-most retainer projecting radially inwardly from an inner surface of the annular stem, wherein each distal-most retainer is in snap-fit engagement with the neck of the medical vial.

The vial adapter further includes a cover supported on the outer annular rim, wherein an expansion chamber is defined within the cover and the base; and an adapter support situated within the cavity of the base. The adapter support includes a male stem extending in a first direction from the base, the male stem selectively connectable to and insertable into an open distal end of a syringe adapter, the male stem defining a lumen extending therethrough; a seal extending across the lumen of the male stem; and a spike extending in a second direction from the inner annular rim and into the opening of the annular stem, wherein the spike includes a first lumen being in fluid communication with the lumen of the male stem, and wherein the spike includes a second lumen being in fluid communication with the expansion chamber.

The vial adapter also includes a bladder extending between the base and the cover.

The vial adapter assembly may include a first position where the proximal-most retainers are in engagement with the neck of the medical vial, and a second position where the distal-most retainers are in engagement with the neck of the medical vial. When when the vial adapter assembly is in the second position, the spike of the vial adapter assembly may penetrate the stopper of the medical vial.

Each proximal-most retainer of the vial adapter may be resilient. Each distal-most retainer of the vial adapter may be resilient. The distal-most retainers may be in axial registration with the spike. Each distal-most retainer of the vial adapter may extend distally and radially inwardly. Each distal-most retainer of the vial adapter may include a shoulder located distal of a tip of the spike.

The spike of the vial adapter may extend towards the plurality of fingers. The plurality of fingers of the vial adapter may include two pair of diametrically opposed fingers. The at least one distal-most retainer may include two pair of diametrically opposed retainers. The spike of the vial adapter may be configured to penetrate the stopper of the medical vial upon an insertion of the neck of the medical vial distally from the proximal-most retainers into engagement with the shoulder of the at least one distal-most retainer.

According to another aspect of the present disclosure, a vial adapter assembly for a closed fluid transfer system is provided and includes a vial adapter. The vial adapter includes a base defining an inner annular rim and an outer annular rim and a cavity therebetween; and an annular stem extending from the base and defining an opening. The annular stem includes a plurality of fingers extending around the opening thereof, wherein each finger terminates in a proximal-most retainer; at least one distal-most retainer projecting radially inwardly from an inner surface of the annular stem; and a pull tab extending from one of the plurality of fingers.

The vial adapter further includes a cover supported on the outer annular rim, wherein an expansion chamber is defined within the cover and the base; and an adapter support situated within the cavity of the base. The adapter support includes a male stem extending in a first direction from the base, the male stem selectively connectable to and insertable into an open distal end of a syringe adapter, the male stem defining a lumen extending therethrough; a seal extending across the lumen of the male stem; and a spike extending in a second direction from the inner annular rim and into the opening of the annular stem, wherein the spike includes a first lumen being in fluid communication with the lumen of the male stem, and wherein the spike includes a second lumen being in fluid communication with the expansion chamber.

This vial adapter also includes a bladder extending between the base and the cover.

Each proximal-most retainer of the vial adapter may be resilient. Each distal-most retainer of the vial adapter may be resilient. The distal-most retainer may be in axial registration with the spike. Each distal-most retainer of the vial adapter may extend distally and radially inwardly. Each distal-most retainer of the vial adapter may include a shoulder located distal of a tip of the spike. The spike of the vial adapter may extend towards the plurality of fingers. The spike of the vial adapter may be configured to penetrate a stopper of a medical vial upon an insertion of a neck of the medical vial distally from the proximal-most retainers into engagement with the shoulder of the at least one distal-most retainer.

According to a further aspect of the present disclosure, a medical vial assembly is provided and includes a medical vial including a neck defining an opening into the vial, and a stopper disposed within the neck and closing the opening of the vial; and a vial adapter.

The vial adapter includes a base defining an inner annular rim and an outer annular rim and a cavity therebetween; and an annular stem extending from the base and defining an opening configured to receive the neck of the medical vial therein. The annular stem includes a plurality of fingers extending around the opening thereof, wherein each finger terminates in a proximal-most retainer; at least one distal-most retainer projecting radially inwardly from an inner surface of the annular stem, wherein each distal-most retainer is in snap-fit engagement with the neck of the medical vial; and a pull tab extending from one of the plurality of fingers.

The vial adapter further includes a cover supported on the outer annular rim, wherein an expansion chamber is defined within the cover and the base; and an adapter support situated within the cavity of the base. The adapter support includes a male stem extending in a first direction from the base, the male stem selectively connectable to and insertable into an open distal end of a syringe adapter, the male stem defining a lumen extending therethrough; a seal extending across the lumen of the male stem; and a spike extending in a second direction from the inner annular rim and into the opening of the annular stem, wherein the spike includes a first lumen being in fluid communication with the lumen of the male stem, and wherein the spike includes a second lumen being in fluid communication with the expansion chamber.

This vial adapter also includes a bladder extending between the base and the cover.

Each proximal-most retainer of the vial adapter may be resilient. Each distal-most retainer of the vial adapter may be resilient. The distal-most retainers may be in axial registration with the spike. Each distal-most retainer of the vial adapter may extend distally and radially inwardly. Each distal-most retainer of the vial adapter may include a shoulder located distal of a tip of the spike. The spike of the vial adapter may extend towards the plurality of fingers. The spike of the vial adapter may be configured to penetrate a stopper of a medical vial upon an insertion of a neck of the medical vial distally from the proximal-most retainers into engagement with the shoulder of the at least one distal-most retainer.

According to yet another aspect of the present disclosure, a medical vial assembly is provided and includes a medical vial including a neck defining an opening into the vial, and a stopper disposed within the neck and closing the opening of the vial; and a vial adapter. The vial adapter includes a base defining an inner annular rim and an outer annular rim and a cavity therebetween; and an annular stem extending from the base and defining an opening configured to receive the neck of the medical vial therein. The annular stem includes at least one retainer projecting radially inwardly from an inner surface of the annular stem, wherein each retainer is spaced an axial distance from the opening of the annular stem, and wherein each retainer is configured for snap-fit engagement with the neck of the medical vial; and at least one gasket extending across the opening of the annular stem, wherein the at least one gasket forms a fluid tight seal between the annular stem of the vial adapter and the neck of the medical vial; a cover supported on the outer annular rim, wherein an expansion chamber is defined within the cover and the base; and an adapter support situated within the cavity of the base. The adapter support includes a male stem extending in a first direction from the base, the male stem selectively connectable to and insertable into an open distal end of a syringe adapter, the male stem defining a lumen extending therethrough; a seal extending across the lumen of the male stem; and a spike extending in a second direction from the inner annular rim and into the opening of the annular stem, wherein the spike includes a first lumen being in fluid communication with the lumen of the male stem, and wherein the spike includes a second lumen being in fluid communication with the expansion chamber.

This vial adapter also includes a bladder extending between the base and the cover.

The at least one gasket of the annular stem of the vial adapter may include a proximal gasket and a distal gasket, wherein each gasket defines a central opening therein. Each gasket may be fabricated from at least one of a rubber or a thermoplastic elastomer.

Each retainer of the vial adapter may be resilient. The retainers may be in axial registration with the spike. Each retainer of the vial adapter may extend distally and radially inwardly. Each retainer of the vial adapter may include a shoulder located distal of a tip of the spike.

The spike of the vial adapter may be configured to penetrate a stopper of a medical vial upon an insertion of a neck of the medical vial distally from engagement with the proximal gasket to engagement with the distal gasket and into engagement with the shoulder of the at least one retainer.

BRIEF DESCTRIPTION OF THE DRAWINGS

In the following, embodiments of the present disclosure will be described in detail with reference to the following attached figures.

DETAILED DESCRIPTION

Figure 1:
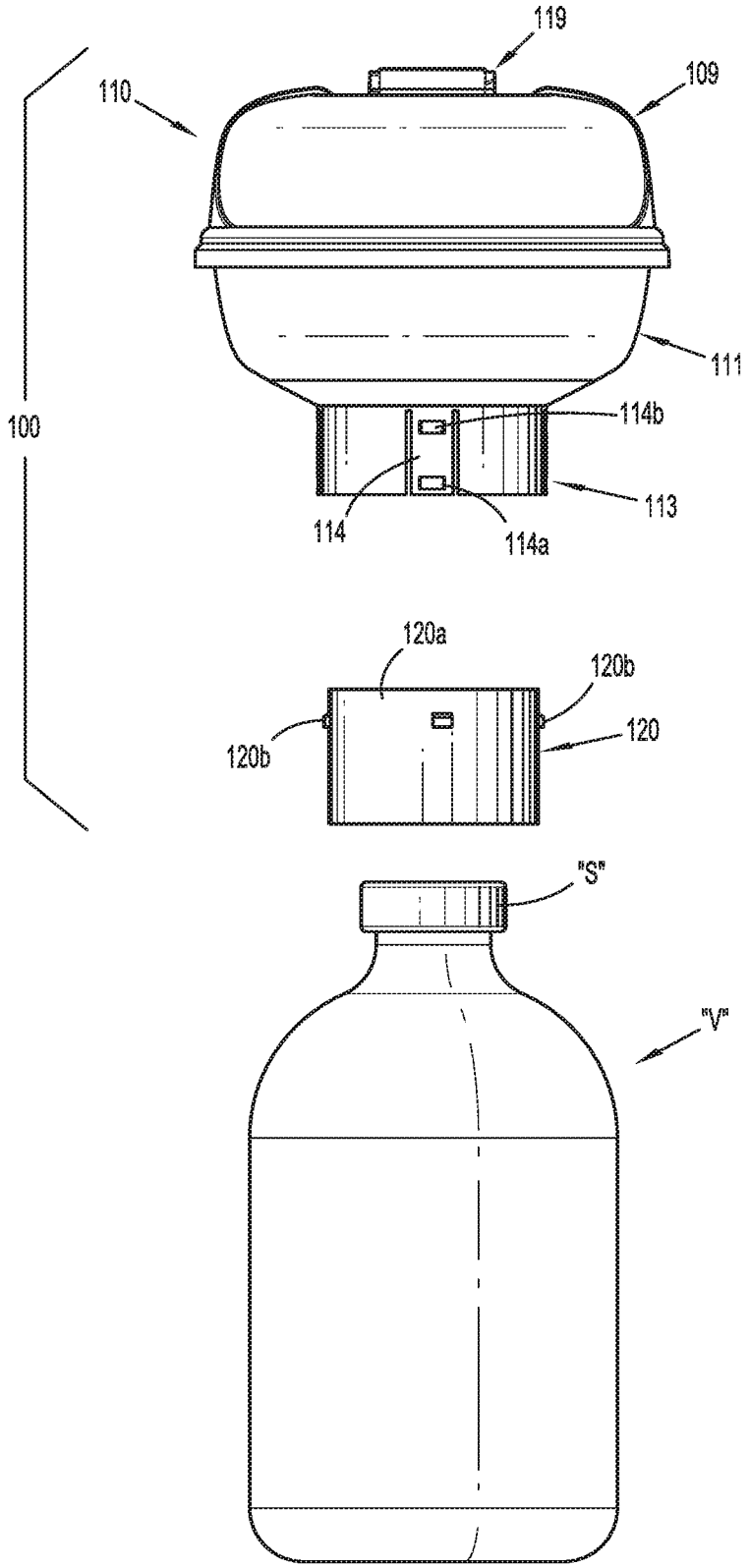
FIG. 1 is a side elevational view, with parts separated, of a medical vial and a vial adapter assembly according to an embodiment of the present disclosure.

In accordance with the present disclosure, with reference to FIGS. 1-25, there is disclosed a medical vial assembly including a medical vial "V" pre-connected, pre-loaded or pre-attached with a vial adapter assembly, e.g., vial adapter assembly 100 in FIGS. 1-9, vial adapter assembly 200 in FIGS. 10-15, vial adapter assembly 300 in FIGS. 16-19, and vial adapter assembly 400 in FIGS. 20-25.

Each vial adapter assembly 100, 200, 300 and 400 generally includes at least a first position wherein vial adapter assembly 100, 200, 300 or 400 is connected to medical vial "V" such that a respective spike 105, 205, 305, 405 thereof does not penetrate a stopper "S" of medical vial "V", and at least a second position wherein vial adapter assembly 100, 200, 300 or 400 is connected to medical vial "V" such that a respective spike 105, 205, 305, 405 thereof penetrates stopper "S" of medical vial "V".

With reference to FIGS. 1-9, vial adapter assembly 100, in conjunction with medical vial "V", is shown and described. Generally, vial adapter assembly 100 connects to a neck of a vial, bottle, or other container "V" holding liquid to be extracted or into which liquid is to be delivered. For convenience, these containers will be referred to collectively by the term "vial." Vial adapter assembly 100 may be provided in sizes and configurations as necessary to attach to commercially-available vials.

Vial adapter assembly 100 includes a vial adapter 110, and an associated vial collar 120. Vial adapter 110 includes a distal end or cover 109, and a proximal end or base 111. Vial adapter 110 further includes an adapter support 103 (including a male stem 119 supporting a seal 123 and including opposed, outwardly extending guide rails 157, 159), a spike 105, and an expansion chamber 107.

Figure 2:
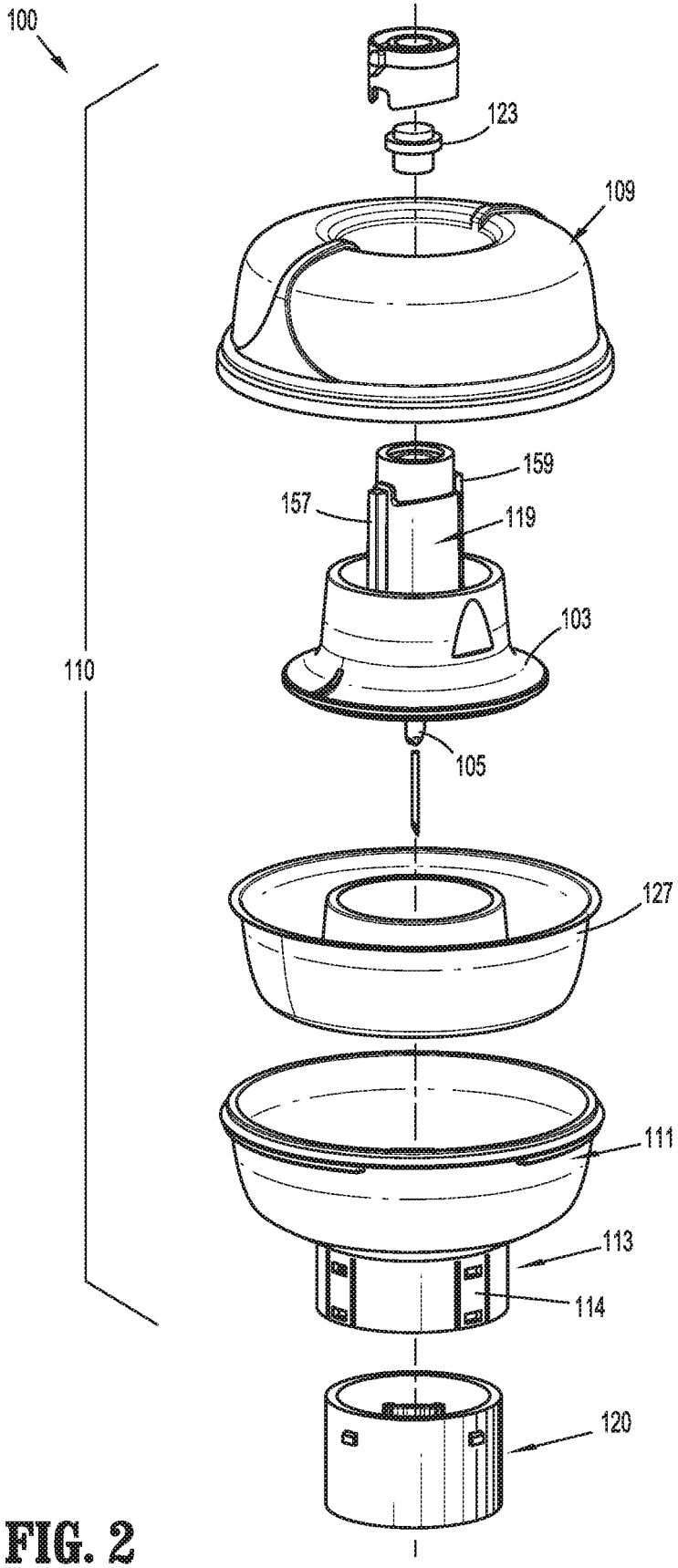
FIG. 2 is a perspective view, with parts separated, of the vial adapter assembly of FIG. 1.
Figure 3:
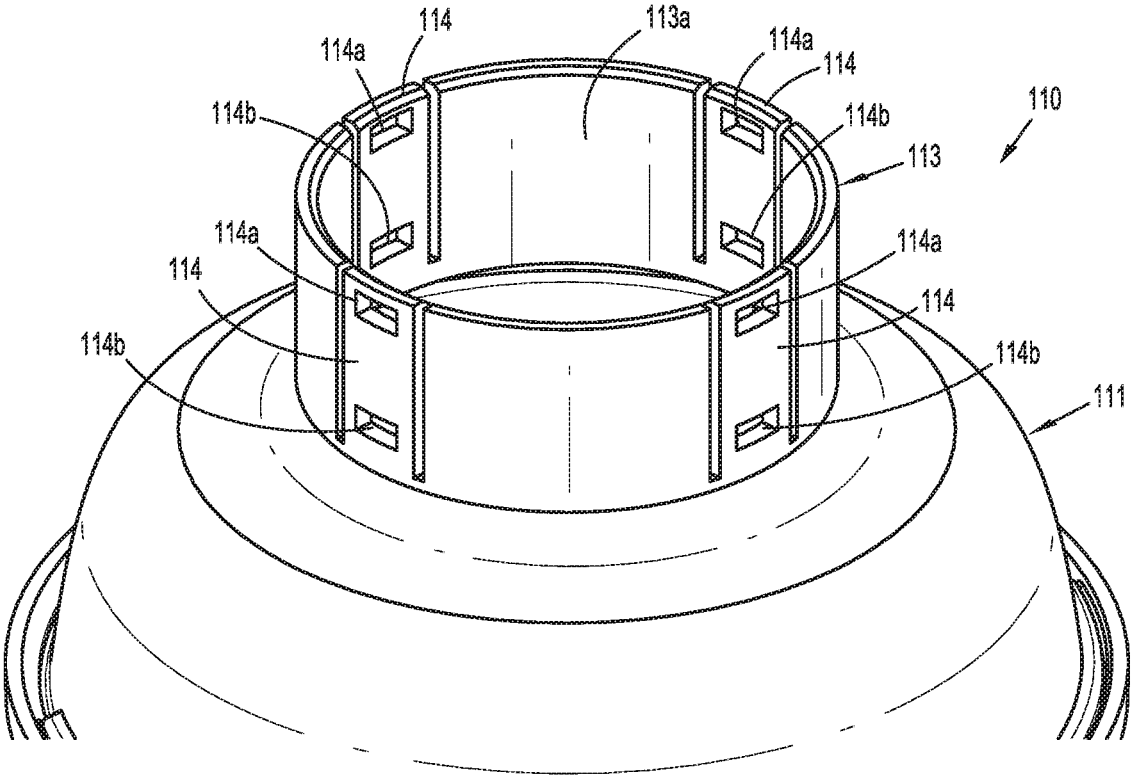
FIG. 3 is a bottom perspective view of a vial adapter of the vial adapter assembly illustrating in FIG. 1.
Figure 4:
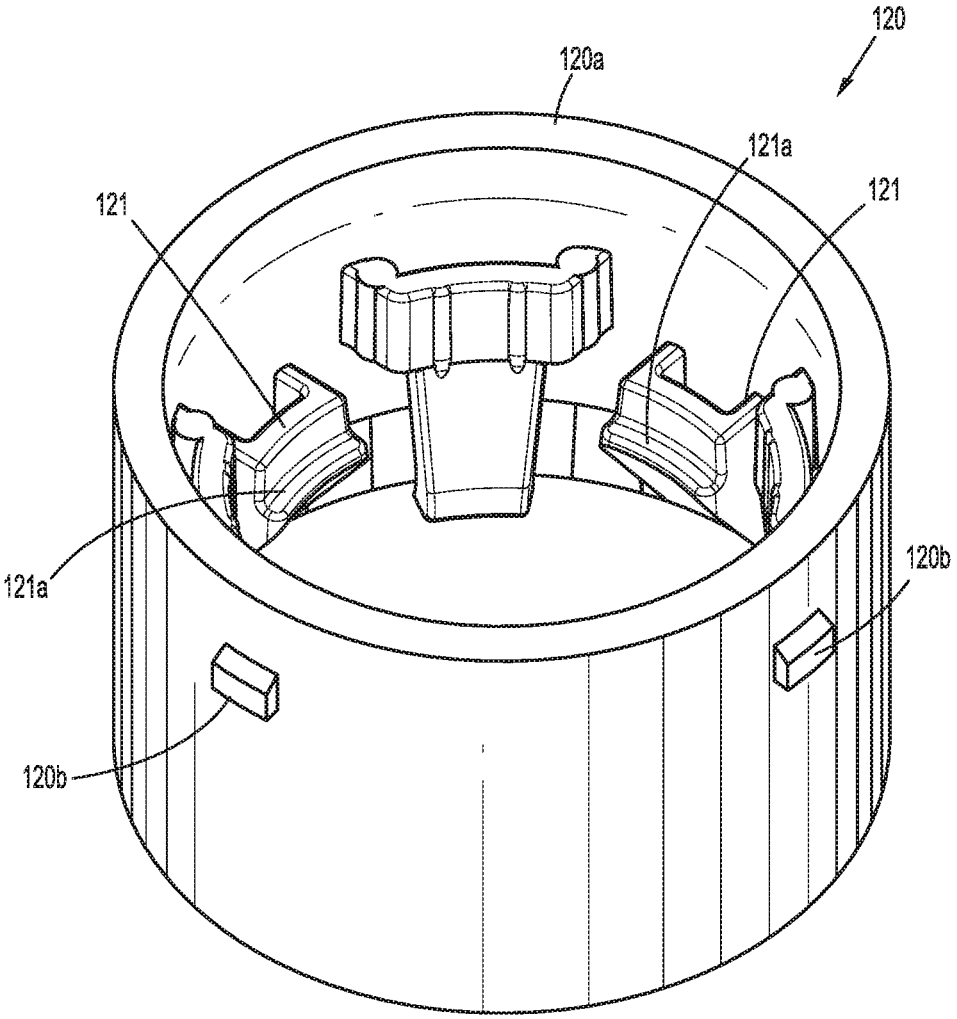
FIG. 4 is a bottom perspective view of a locking collar of the vial adapter assembly illustrating in FIG. 1.
Figure 5:
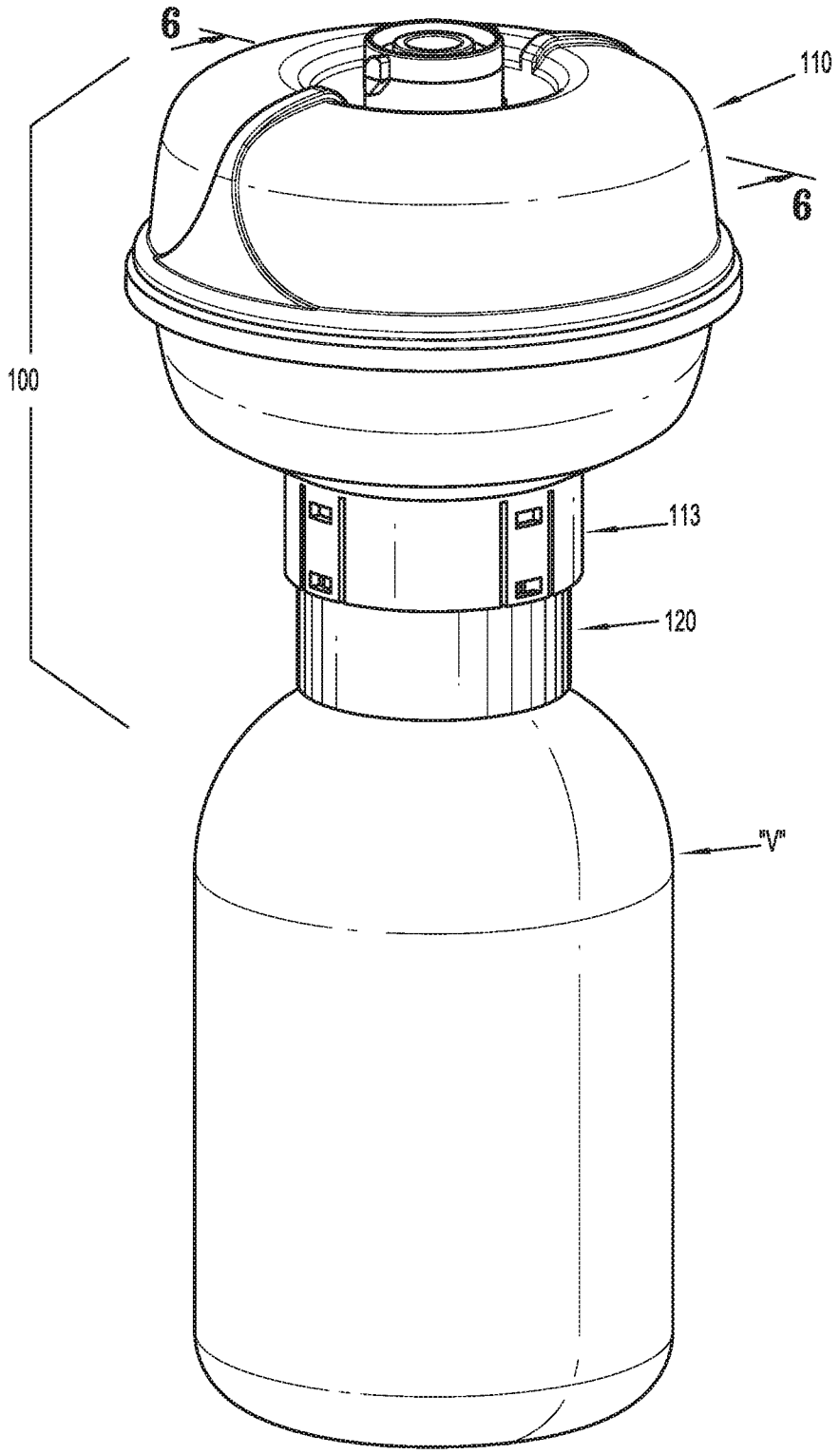
FIG. 5 is a perspective view of the vial adapter assembly of FIG. 1, shown attached to the medical vial, illustrating the vial adapter assembly in a first, non-penetrating position.
Figure 6:
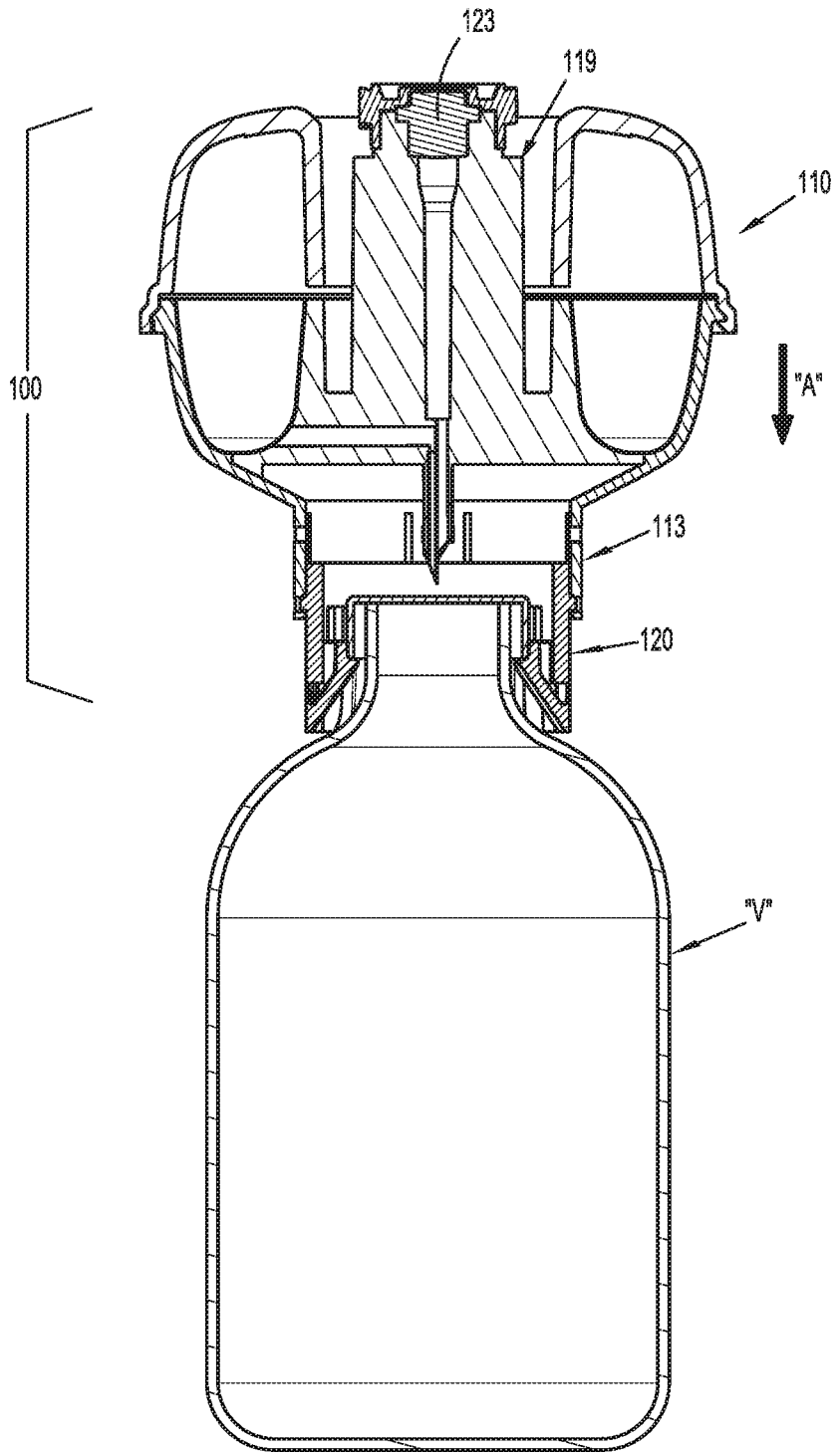
FIG. 6 is a longitudinal, cross-sectional view of the vial adapter assembly and medical vial of FIG. 5, as taken through 6-6 of FIG. 5.
Figure 7:
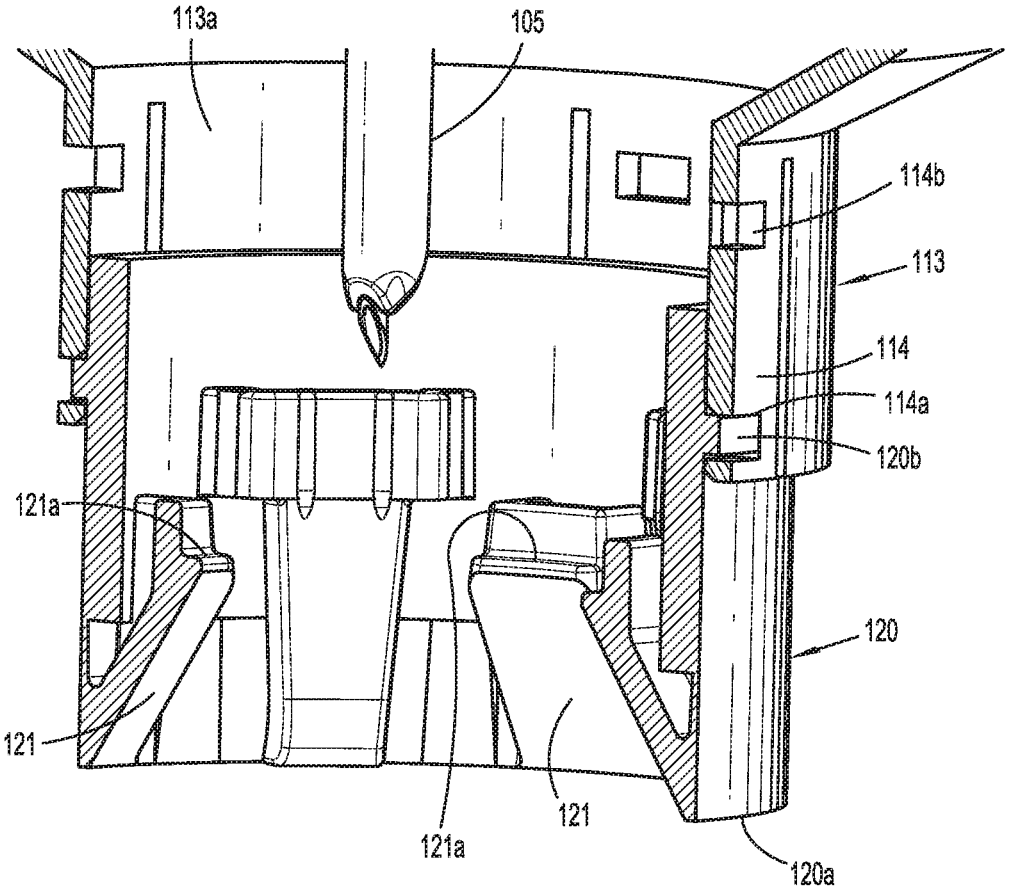
FIG. 7 is a cross-sectional, perspective view of an annular stem and vial collar of the vial adapter assembly of FIGS. 1-6.

As shown in FIGS. 1-3, proximal end 111 of vial adapter 110 is substantially bowl-shaped and is configured to receive and/or seat adapter support 103 thereon. Vial adapter 110 includes a toroid-shaped expansion chamber 107, including a bladder 127 and translucent distal end or cover 109, seated on an inner rim and an outer rim of proximal end 111. Bladder 127 has a substantially U-shaped radial cross-section including a first annular rim captured between an outer annular rim of proximal end 111 and an outer annular rim of distal end 109 of vial adapter 110, and a second annular rim captured between an inner annular rim of proximal end 111 and an inner annular rim of distal end 109 of vial adapter 110.

Proximal end 111 of vial adapter assembly 100 includes an annular stem 113 extending therefrom. Annular stem 113 defines an opening 113*a* therein into which vial collar 120 is disposed. Annular stem 113 includes at least a pair of proximally extending resilient fingers 114 along a radial length thereof. Each finger 114 includes a proximal window or recess 114*a* and a distal window or recess 114*b* formed therein.

Distal end 109 of vial adapter 110 is substantially bowl-shaped and is configured to receive and/or seat an adapter support thereon. Vial adapter 110 includes a toroid-shaped expansion chamber including a bladder, and a translucent cover seated on an inner rim and an outer rim of proximal end 111. The bladder has a substantially U-shaped radial cross-section including a first annular rim captured between the outer annular rim of proximal end 111 and the outer annular rim of the cover, and a second annular rim captured between the inner annular rim of proximal end 111 and the inner annular rim of the cover.

Figure 9:
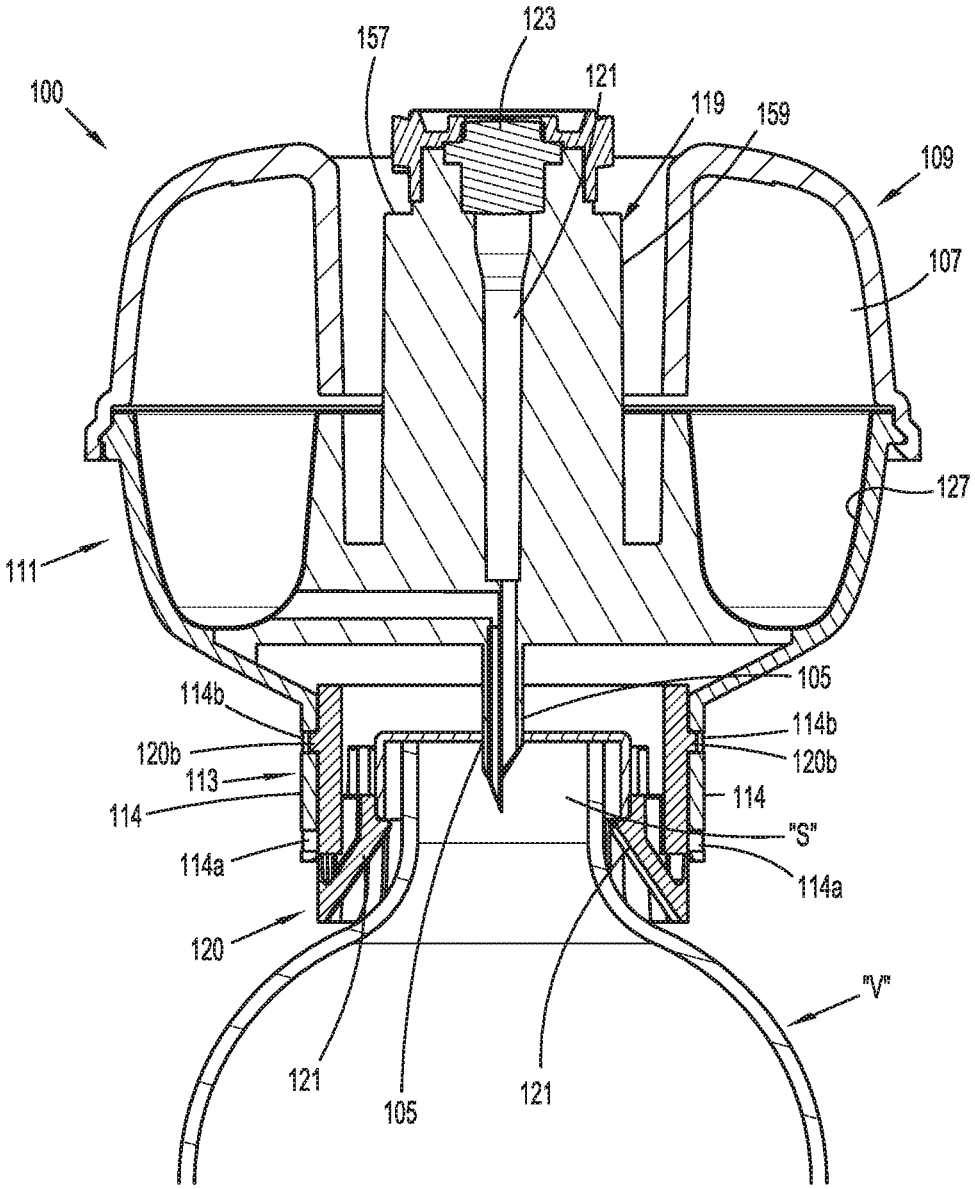
FIG. 9 is a longitudinal cross-sectional view of the vial adapter assembly and medical vial of FIG. 8.

As seen in FIG. 9, spike 105 of vial adapter assembly 100 extends away from proximal end 111 of vial adapter 110 and includes a tip configured to pierce the stopper or septum "S" provided on medical vial "V". Spike 105 has a length sufficient to extend into medical vial "V" when vial adapter assembly 100 is in the second position. Spike 105 may be made of plastic, however, it is envisioned that spike 105 may support a metallic piercing member or hypo-tube to assist in the ability of spike 105 to penetrate the stopper "S" of medical vial "V". Spike 105 is in axial registration with distal window or recess 114*b* of finger 114 of annular stem 113.

Spike 105 and proximal end 111 of vial adapter 110 may define two ducts. A first duct of spike 105 may extend between the tip of spike 105 and a lumen of a male stem 119 of distal end 109 of vial adapter 110, and is provided to permit fluid flow between medical vial "V" and male stem 119. A second duct of spike 105 may extend between the tip of spike 105 and a first cavity of a chamber defined within the expansion chamber when the toroid-shaped bladder is deflated. The chamber of the expansion chamber expands upon a movement of the bladder when air or other gas is injected into male stem 119 and a duct from a syringe that is attached to a syringe adapter.

Vial collar 120 includes an annular body 120*a* having at least a pair of tabs 120*b* extending outwardly therefrom, wherein the pair of tabs 120*b* are radially aligned with proximal and distal windows 114*a*, 114*b* of fingers 114 of annular stem 113 of vial adapter 110. Annular body 120*a* of vial collar 120 defines a circular central opening into which a neck of medical vial "V" is received.

Vial collar 120 includes retainers 121 around the circumference of annular body 120*a* which extend radially inward and distally, and which are configured to connect vial collar 120 of vial adapter assembly 100 to the neck of medical vial "V" to form a connection between vial adapter assembly 100 and medical vial "V" when the neck of medical vial "V" is inserted into central opening of annular body 120*a*. Each retainer 121 defines a ledge or shoulder 121*a* therein for engagement with the neck of the medical vial "V".

Vial collar 120 is connected to annular stem 113 of vial adapter such that the pair of tabs 120*b* of annular body 120*a* are disposed within either proximal or distal windows 114*a*, 114*b* of fingers 114 of annular stem 113 of vial adapter 110. When the pair of tabs 120*b* of annular body 120*a* are disposed within proximal windows 114*a* of fingers 114 of annular stem 113 of vial adapter 110, vial adapter assembly 100 is in the first position, as described above. When the pair of tabs 120*b* of annular body 120*a* are disposed within distal windows 114*b* of fingers 114 of annular stem 113 of vial adapter 110, vial adapter assembly 100 is in the second position, as described above.

It is contemplated and understood that vial collar 120 may be sized to accommodate different size necks of different size vials, such as, for example, a 20 mm vial cap of a 60 ml vial; a 28 mm vial cap of a 60 ml vial; and a 13 mm vial cap of a 20 ml vial. Accordingly, a diameter of vial collar 120 may be sized appropriately so as to accommodate at least the caps of the vials identified above.

Figure 8:
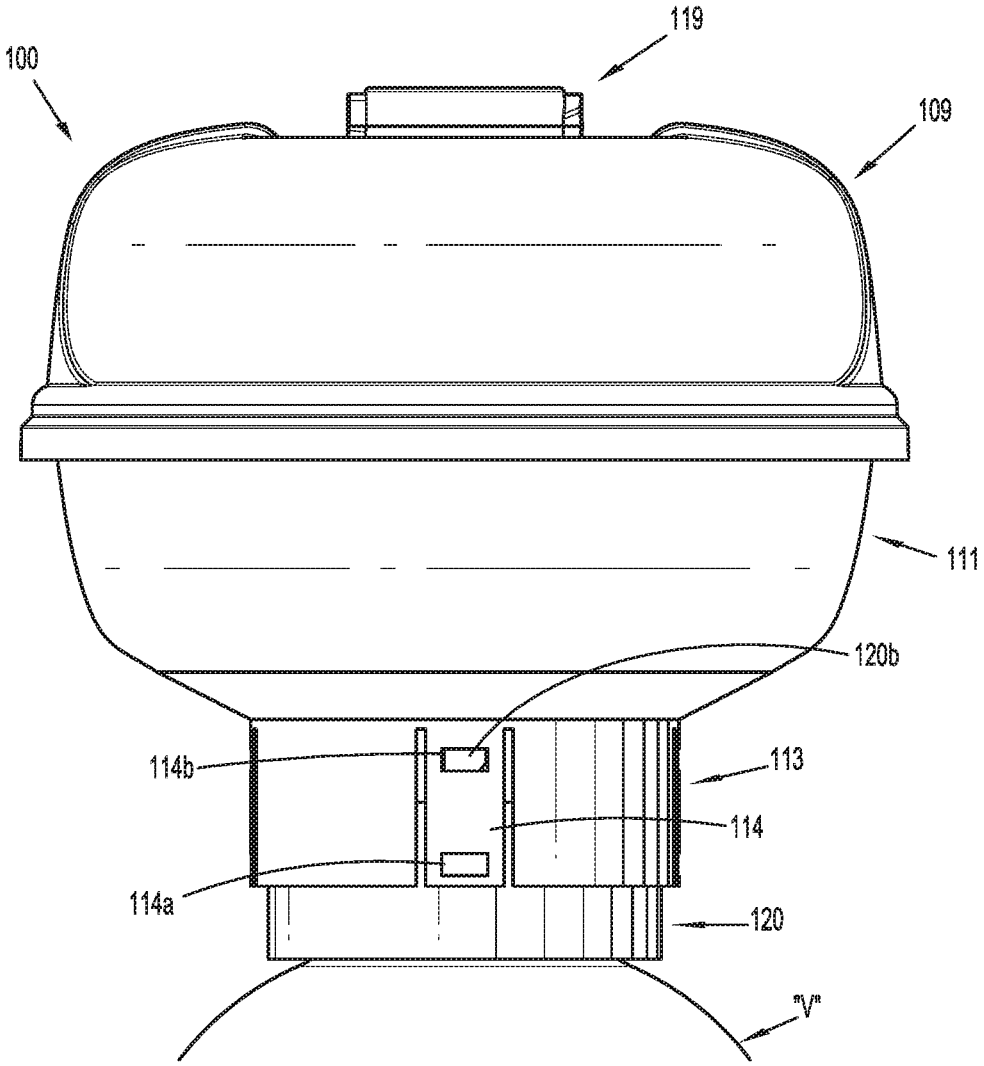
FIG. 8 is a side elevational view the vial adapter assembly of FIG. 1 shown attached to the medical vial, illustrating the vial adapter assembly in a second, penetrating position.

As described above, medical vial "V" is provided with vial adapter assembly 100 pre-connected, pre-loaded or pre-attached thereto with vial adapter assembly 100 in the first position, wherein spike 105 of vial adapter assembly 100 does not penetrate stopper "S" of medical vial "V". In use, when it is time to access the contents of medical vial "V", vial adapter assembly 100 is actuated from the first position to the second position by proximally displacing vial adapter 110 relative to vial collar 120, as indicated by arrow "A" of FIG. 6. In so doing, the pair of tabs 120*b* of annular body 120*a* are moved from within proximal windows 114*a* of fingers 114 of annular stem 113 of vial adapter 110 to distal windows 114*b* of fingers 114 of annular stem 113. Additionally, in so doing, as illustrated in FIG. 8, spike 105 of vial adapter 110 is advanced to penetrate stopper "S" of medical vial "V".

With reference to FIGS. 10-15, vial adapter assembly 200, in conjunction with medical vial "V", is shown and described. Vial adapter assembly 200 includes a vial adapter 210 having distal and proximal ends 209, 211. Vial adapter 210 includes a distal end or cover 209, and a proximal end or base 211. Vial adapter 210 further includes an adapter support 203 (including a male stem 219 supporting a seal 223 and including opposed, outwardly extending guide rails 257, 259), a spike 205, and an expansion chamber 207.

Distal end 209 of vial adapter 210 is substantially bowl-shaped and is configured to receive and/or seat an adapter support thereon. Vial adapter 210 includes a toroid-shaped expansion chamber including a bladder, and a translucent cover seated on an inner rim and an outer rim of proximal end 211. The bladder has a substantially U-shaped radial cross-section including a first annular rim captured between the outer annular rim of proximal end 211 and the outer annular rim of the cover, and a second annular rim captured between the inner annular rim of proximal end 211 and the inner annular rim of the cover.

Figure 10:
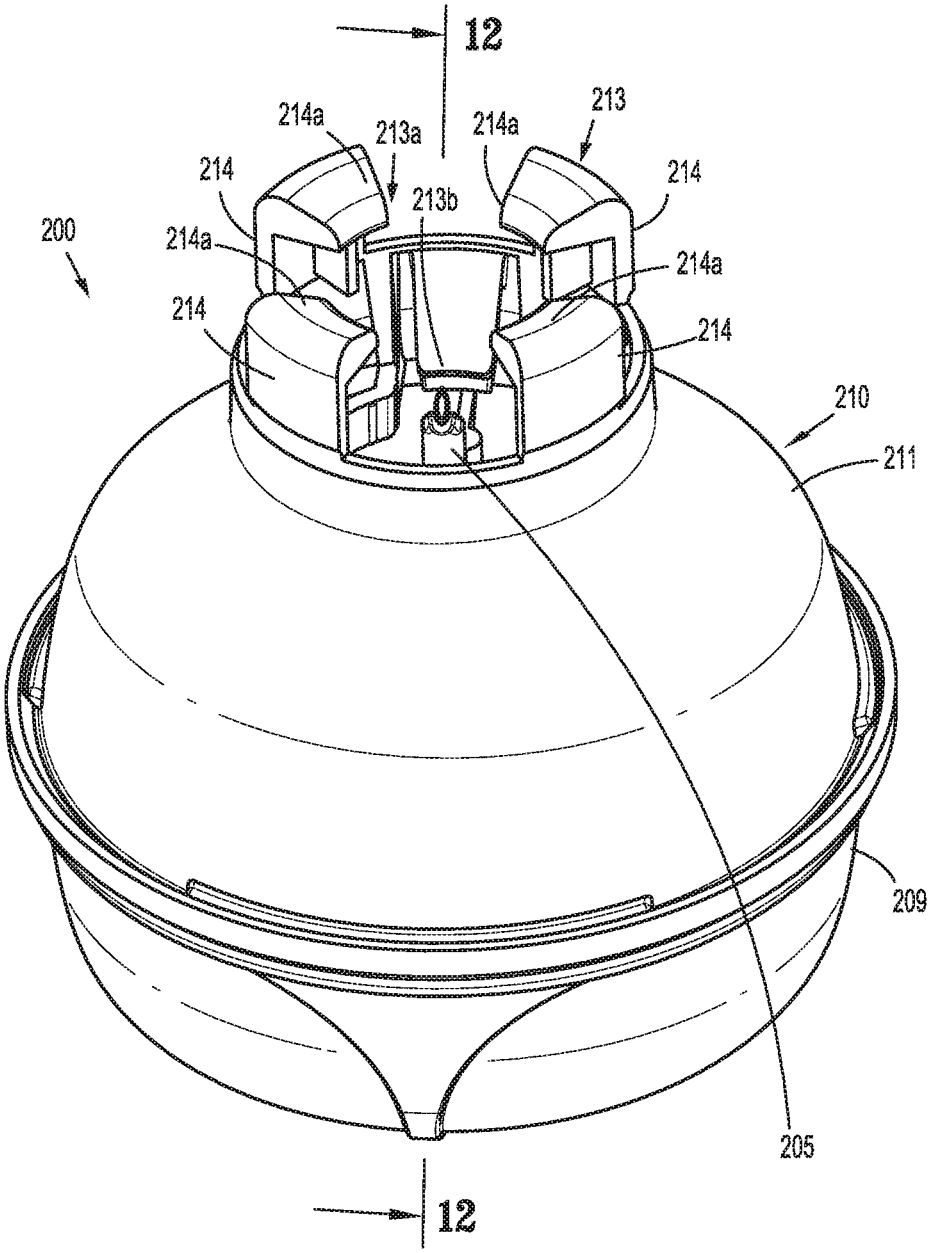
FIG. 10 is a bottom perspective view of a vial adapter assembly according to another embodiment of the present disclosure.
Figure 11:
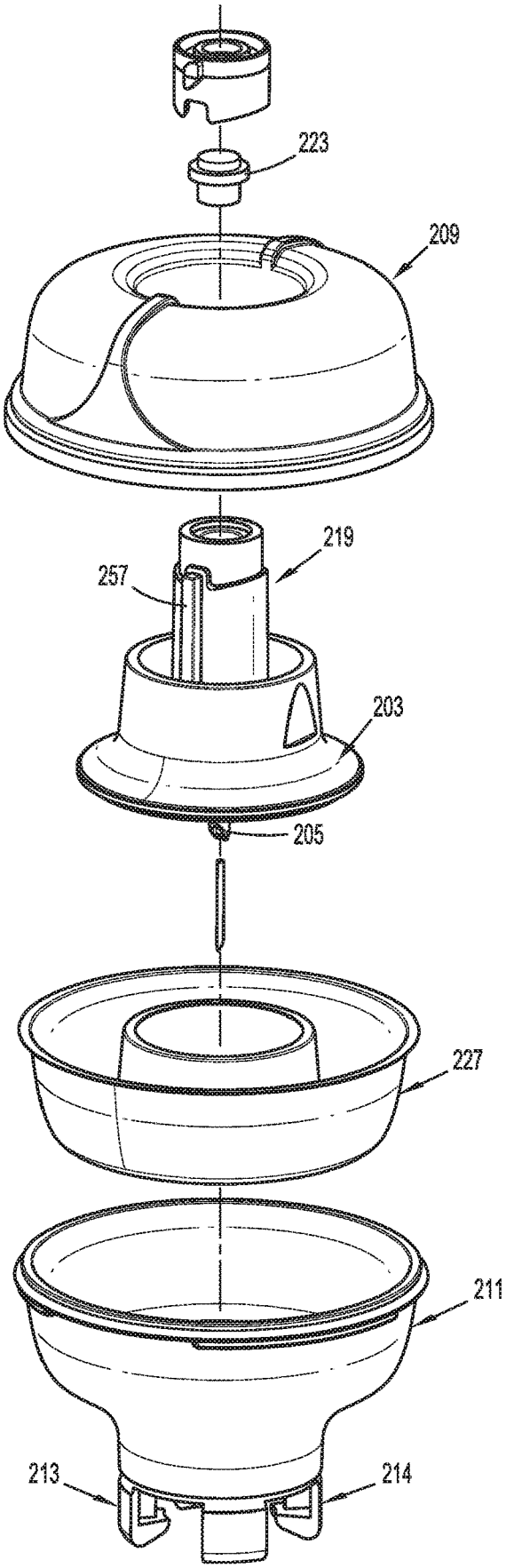
FIG. 11 is a perspective view, with parts separated, of the vial adapter assembly of FIG. 10.
Figure 12:
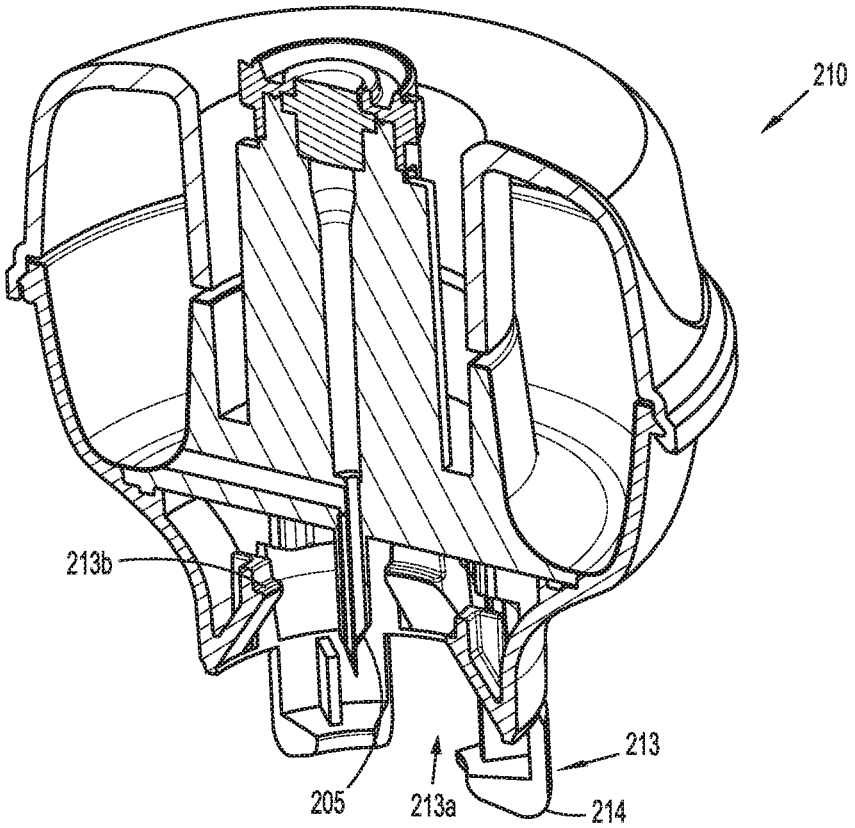
FIG. 12 is a longitudinal, cross-sectional view of the vial adapter assembly of FIGS. 10 and 11, as taken through 12-12 of FIG. 10.

As shown in FIGS. 10-12, proximal end 211 of vial adapter 210 is substantially bowl-shaped and is configured to receive and/or seat adapter support 203 thereon. Vial adapter 210 includes a toroid-shaped expansion chamber 207, including a bladder 227 and translucent distal end or cover 209, seated on an inner rim and an outer rim of proximal end 211. Bladder 227 has a substantially U-shaped radial cross-section including a first annular rim captured between an outer annular rim of proximal end 211 and an outer annular rim of distal end 209 of vial adapter 210, and a second annular rim captured between an inner annular rim of proximal end 211 and an inner annular rim of distal end 209 of vial adapter 210.

Proximal end 211 of vial adapter assembly 200 includes an annular stem 213 extending therefrom. Annular stem 213 defines an opening 213*a* therein into which the neck of medical vial "V" is to be disposed. Annular stem 213 includes at least a pair of proximally extending resilient fingers 214 (two pair being shown) along a radial length thereof. Each finger 214 includes a respective proximal-most retainer or tab 214*a* extending radially inwardly therefrom. Proximal-most retainers 214*a* of fingers 214 are configured to connect vial adapter assembly 200 to the neck of medical vial "V" to form a connection, in the first position, between vial adapter assembly 200 and medical vial "V" when the neck of medical vial "V" is inserted into central opening of annular stem 213.

Figure 13:
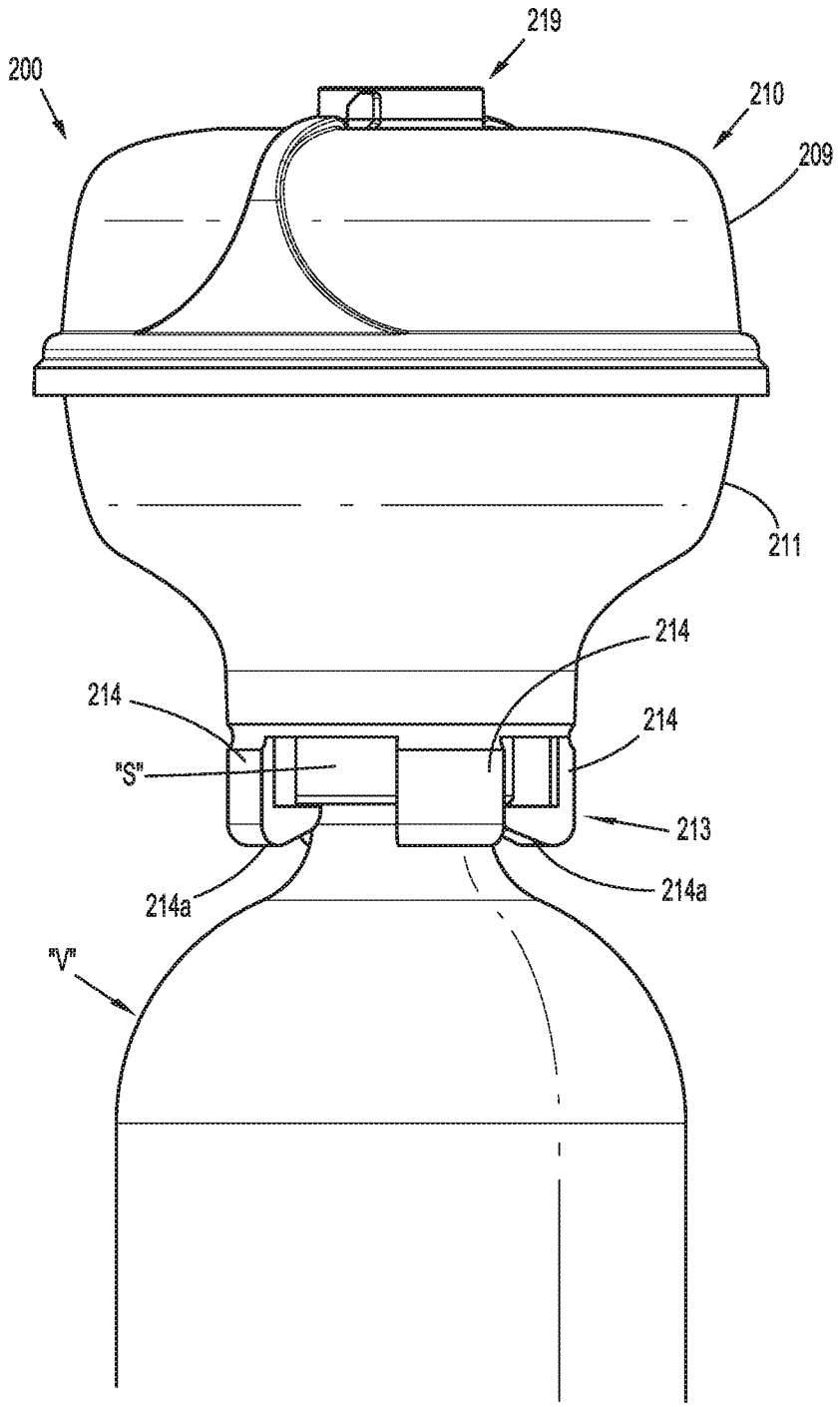
FIG. 13 is a side elevational view the vial adapter assembly of FIGS. 10-12 shown attached to the medical vial.
Figure 14:
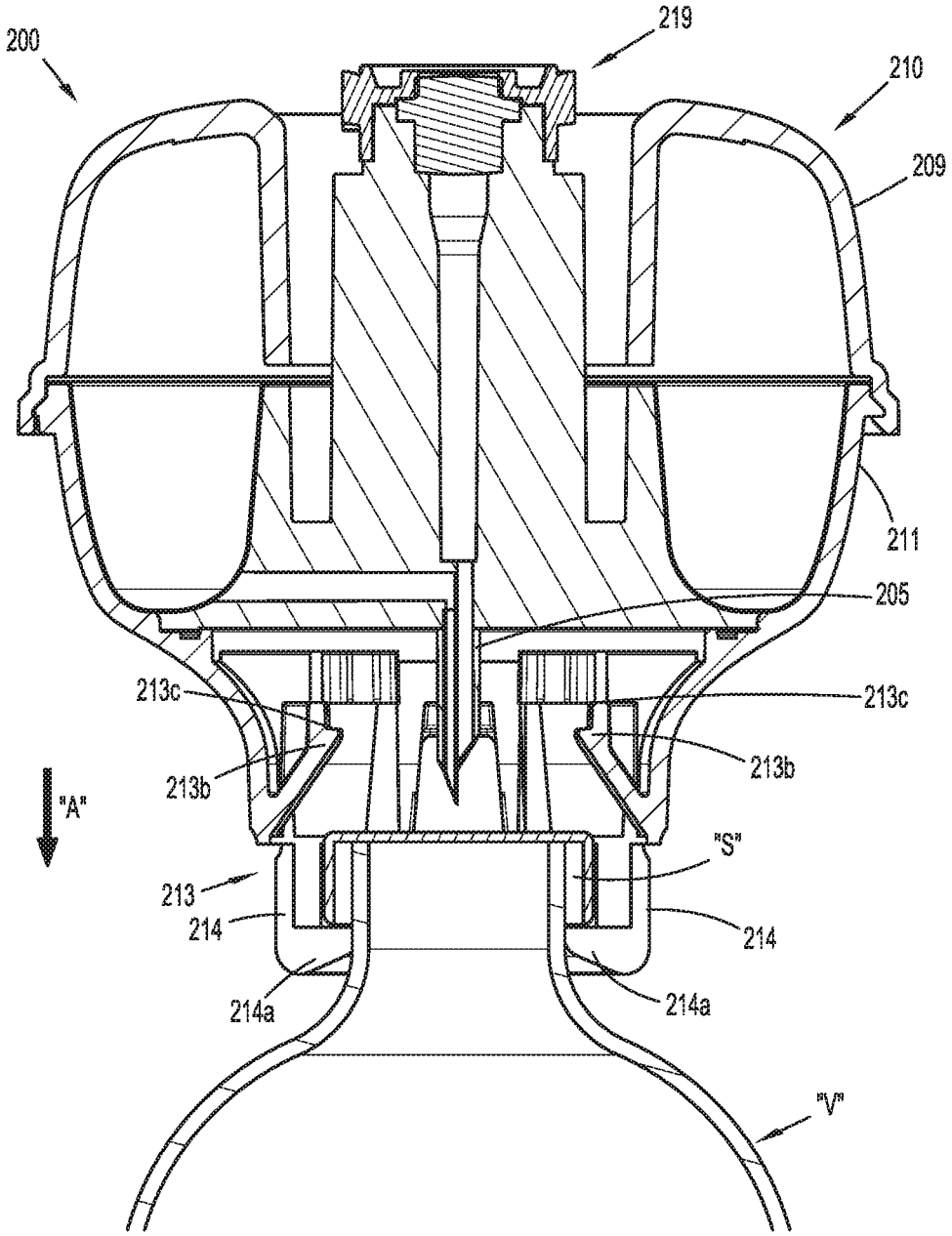
FIG. 14 is a longitudinal cross-sectional view of the vial adapter assembly and medical vial of FIG. 13, illustrating the vial adapter assembly in a first, non-penetrating position.
Figure 15:
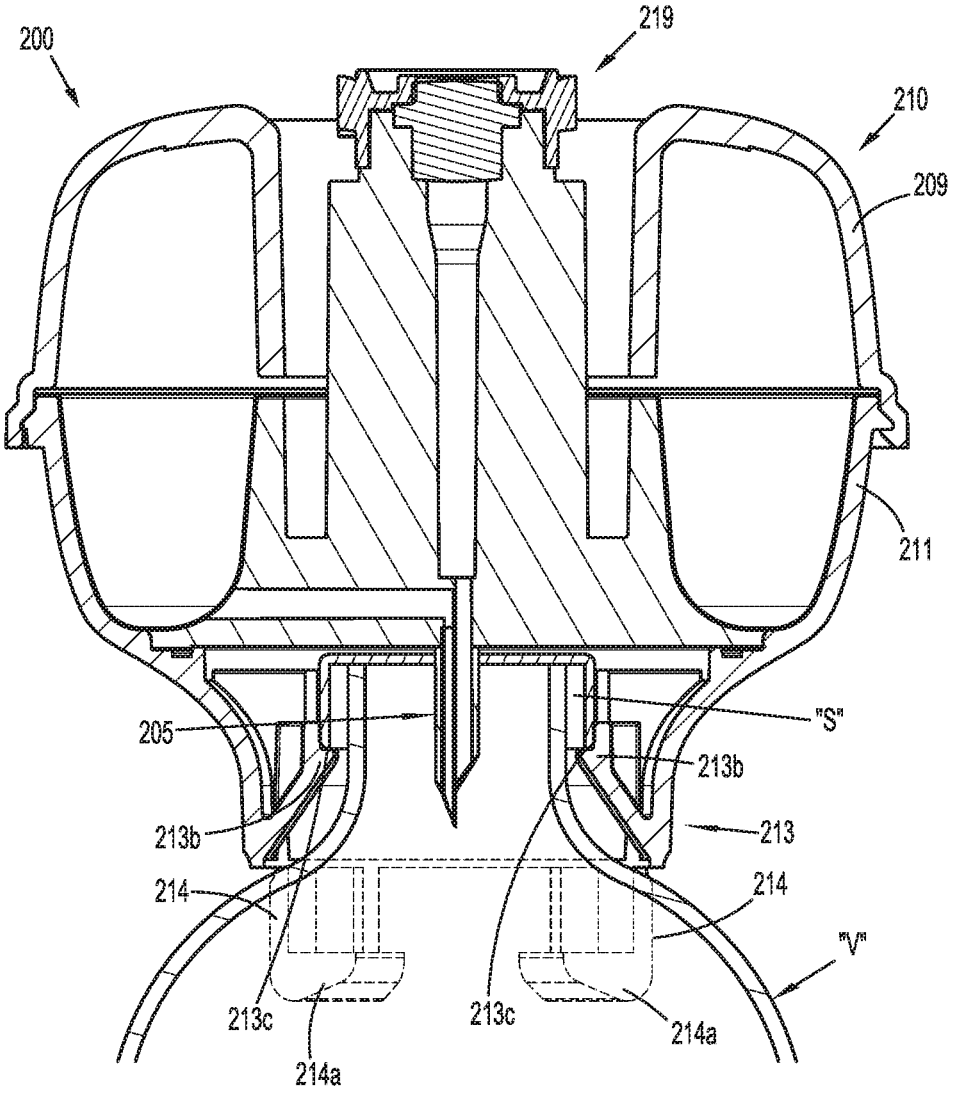
FIG. 15 is a longitudinal cross-sectional view of the vial adapter assembly and medical vial of FIG. 13, illustrating the vial adapter assembly in a second, penetrating position.
Figure 16:
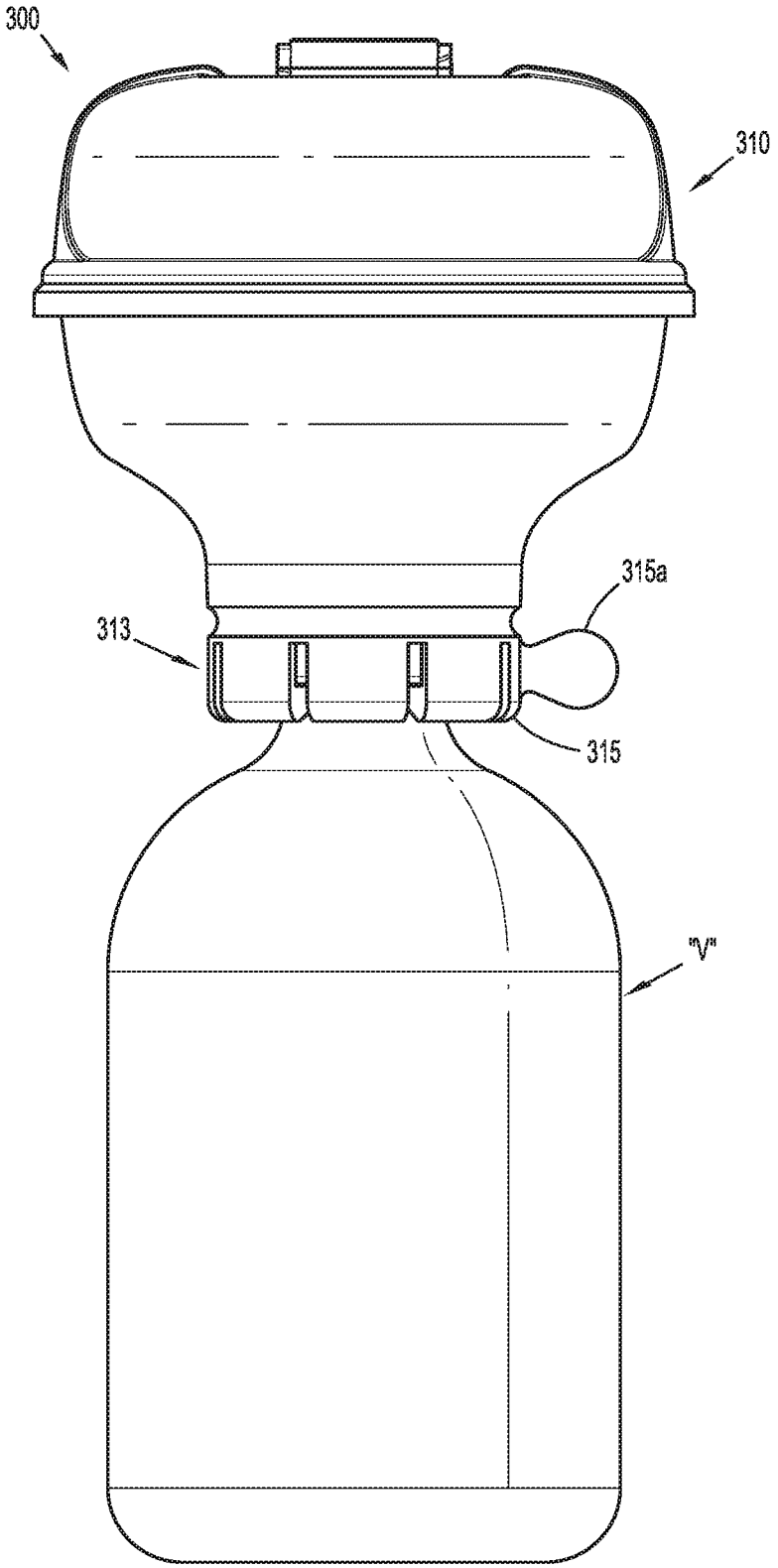
FIG. 16 is a side elevational view a vial adapter assembly, according to yet another embodiment of the present disclosure, shown attached to the medical vial, illustrating the vial adapter assembly in a first, non-penetrating position.

With reference to FIGS. 12, 13 and 15, annular stem 213 also includes at least two pair of distal-most retainer 213*b* extending radially inwardly therefrom. Distal-most retainers 213*b* are disposed distal of proximal-most retainers 214*a*. Each proximal-most retainer 213*b* is in the form of a resilient arm extending distally and radially inwardly. Each proximal-most retainer 213*b* defines a shoulder or ledge 213*c* which is configured to engage a shoulder of the neck of the medical vial "C". Specifically, distal-most retainers 213*a* of annular stem 213 are configured to connect vial adapter assembly 200 to the neck of medical vial "V" to form a connection, in the second position, between vial adapter assembly 200 and medical vial "V" when vial adapter assembly 200 is actuated from the first position to the second position.

As seen in FIGS. 10, and 13-15, spike 205 of adapter assembly 200 extends away from proximal end 211 of vial adapter 210 and includes a tip configured to pierce the stopper or septum "S" provided on medical vial "V". Spike 205 has a length sufficient to extend into medical vial "V" when vial adapter assembly 200 is in the second position. Spike 205 may be made of plastic, however, it is envisioned that spike 205 may support a metallic piercing member or hypo-tube to assist in the ability of spike 205 to penetrate the stopper "S" of medical vial "V". Spike 205 is in axial registration with distal-most retainers 213*b* of annular stem 213.

Spike 205 and proximal end 211 of vial adapter 210 may define two ducts. A first duct of spike 205 may extend between the tip of spike 205 and a lumen of a male stem 219 of distal end 209 of vial adapter 210, and is provided to permit fluid flow between medical vial "V" and male stem 219. A second duct of spike 205 may extend between the tip of spike 205 and a first cavity of a chamber defined within the expansion chamber when the toroid-shaped bladder is deflated. The chamber of the expansion chamber expands upon a movement of the bladder when air or other gas is injected into male stem 219 and a duct from a syringe that is attached to a syringe adapter.

As described above, as illustrated in FIGS. 13 and 14, medical vial "V" is provided with vial adapter assembly 200 pre-connected, pre-loaded or pre-attached thereto with vial adapter assembly 200 in the first position, wherein spike 205 of vial adapter assembly 200 does not penetrate stopper "S" of medical vial "V". In use, when it is time to access the contents of medical vial "V", vial adapter 210 of vial adapter assembly 200 is actuated from the first position to the second position by proximally displacing vial adapter 210 relative to the neck of medical vial "V", as indicated by arrow "A" in FIG. 14. In so doing, as illustrated in FIG. 15, distal-most retainers 213*a* of annular stem 213 of vial adapter 210 are moved into connection with the neck (e.g., with a shoulder or flange of the neck) of medical vial "V". Additionally, in so doing, as also illustrated in FIG. 15, spike 205 of vial adapter 210 is advanced to penetrate stopper "S" of medical vial "V".

Turning now to FIGS. 16-19, vial adapter assembly 300 is shown and described. Vial adapter assembly 300 is substantially similar to vial adapter assembly 200 and thus, will only be described herein in detail to discuss the differences in construction and operation thereof. Vial adapter assembly 300 includes a vial adapter 310 having a distal end or cover 309, and a proximal end or base 311. Vial adapter 310 further includes an adapter support 303 (including a male stem 319 supporting a seal 323 and including opposed, outwardly extending guide rails 357, 359), a spike 305, and an expansion chamber 307.

Distal end 309 of vial adapter 310 is substantially bowl-shaped and is configured to receive and/or seat an adapter support thereon. Vial adapter 310 includes a toroid-shaped expansion chamber including a bladder, and a translucent cover seated on an inner rim and an outer rim of proximal end 311. The bladder has a substantially U-shaped radial cross-section including a first annular rim captured between the outer annular rim of proximal end 311 and the outer annular rim of the cover, and a second annular rim captured between the inner annular rim of proximal end 311 and the inner annular rim of the cover.

Figure 17:
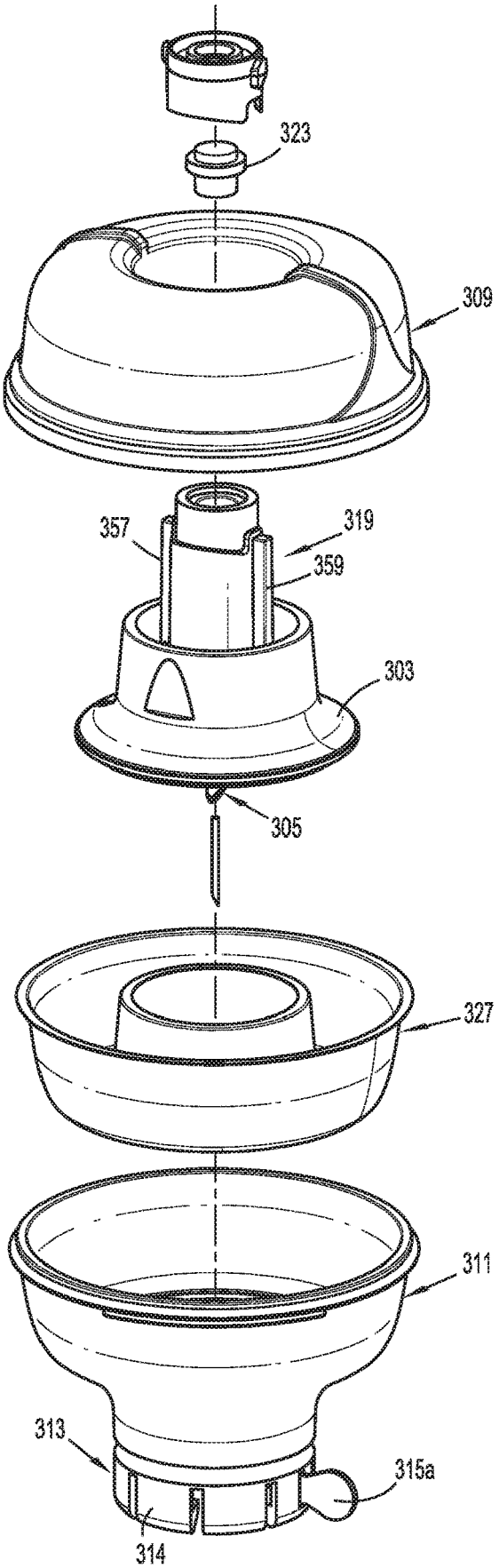
FIG. 17 is a perspective view, with parts separated, of the vial adapter assembly of FIG. 16.
Figure 18:
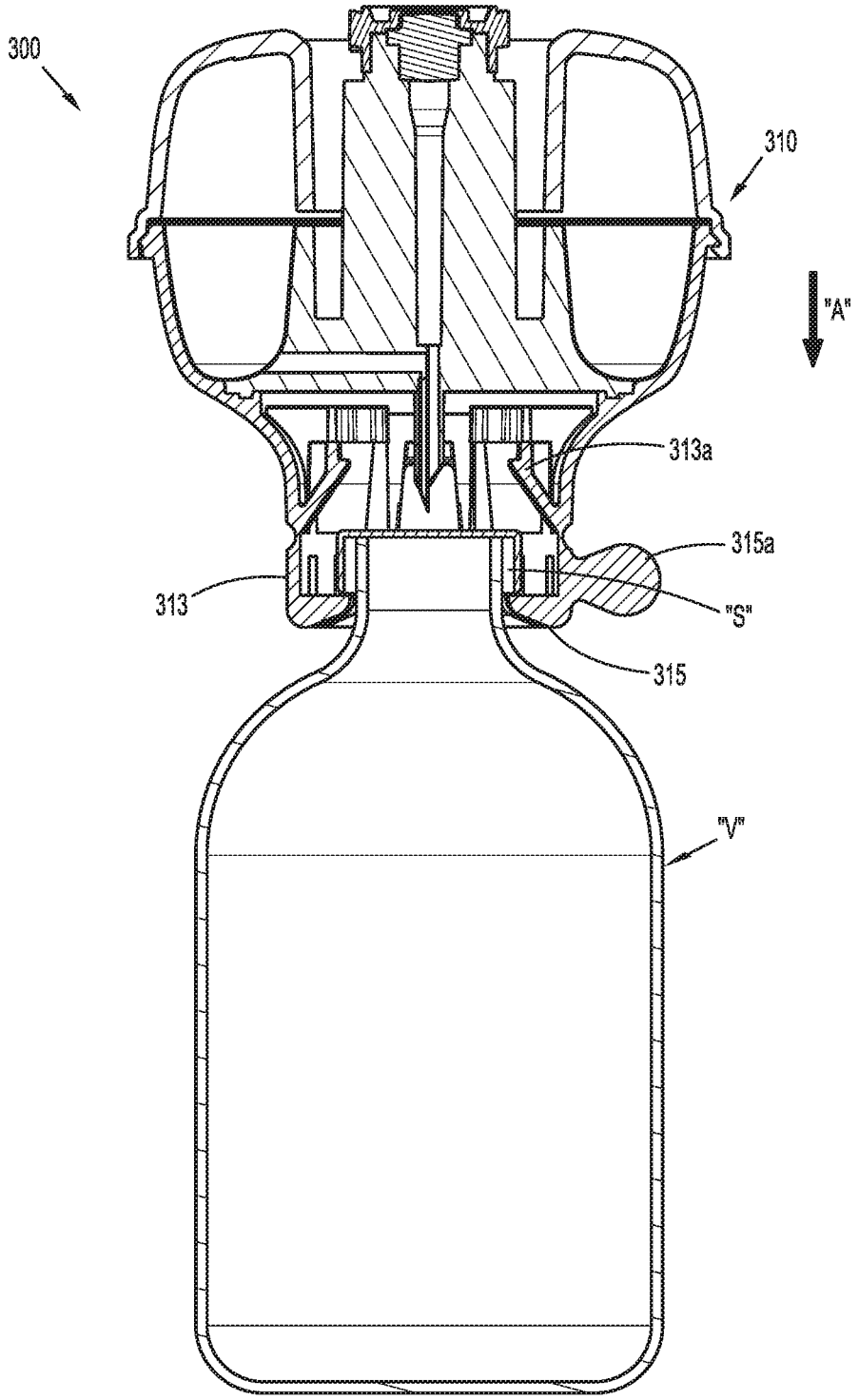
FIG. 18 is a longitudinal, cross-sectional view of FIG. 16.
Figure 19:
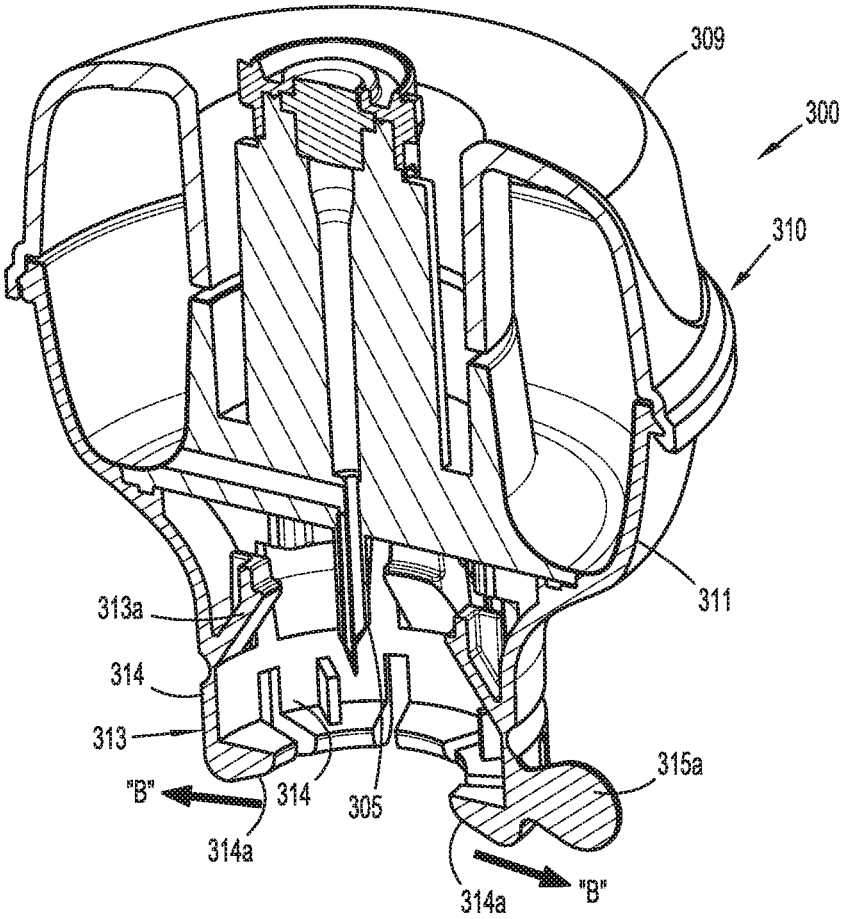
FIG. 19 is a perspective, cross-sectional view of the vial adapter assembly of FIGS. 16-18.
Figure 20:
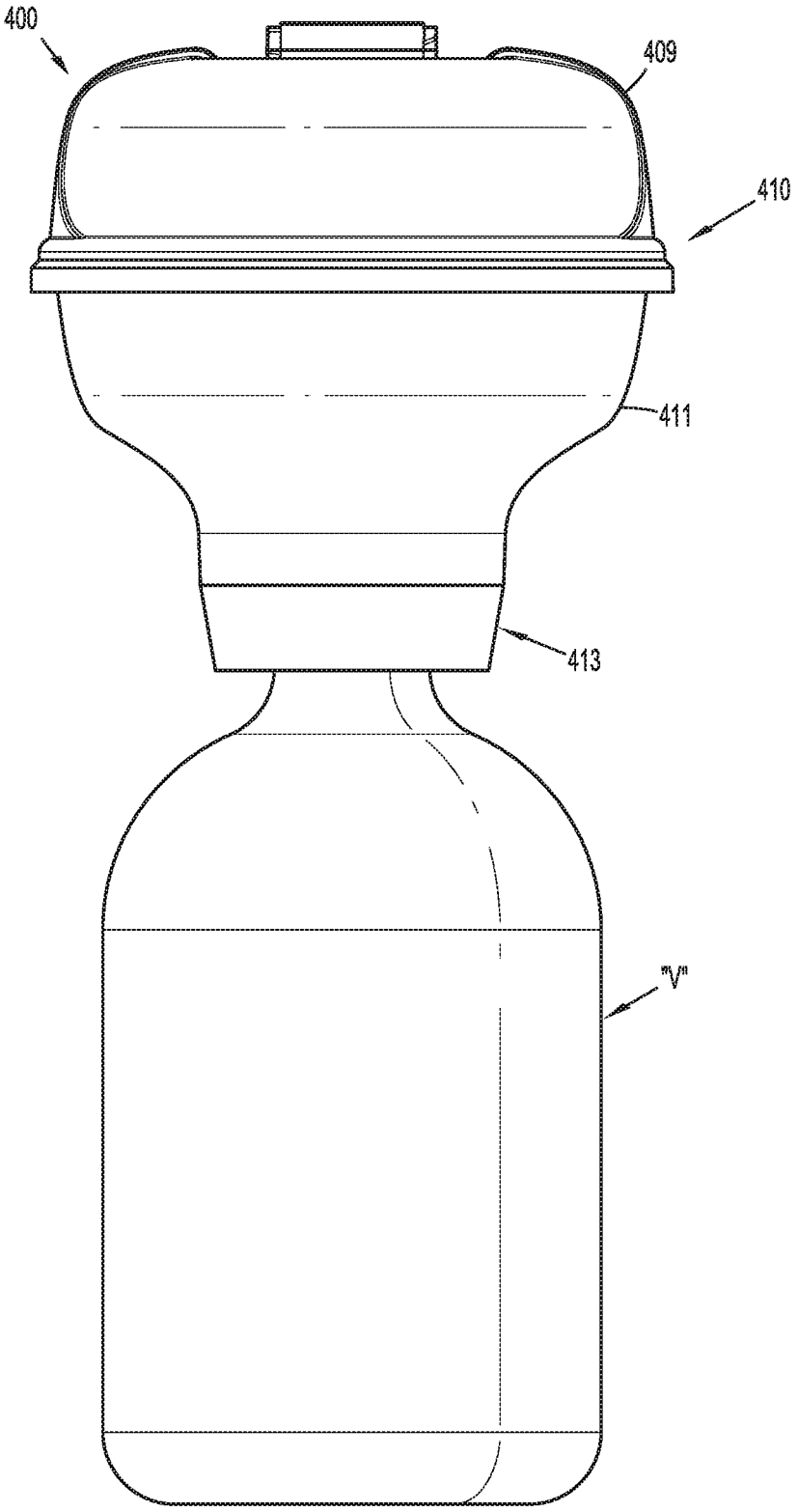
FIG. 20 is an elevational view of a vial adapter assembly, according to still another embodiment of the present disclosure, shown attached to the medical vial, illustrating the vial adapter assembly in a first, non-penetrating position.
Figure 21:
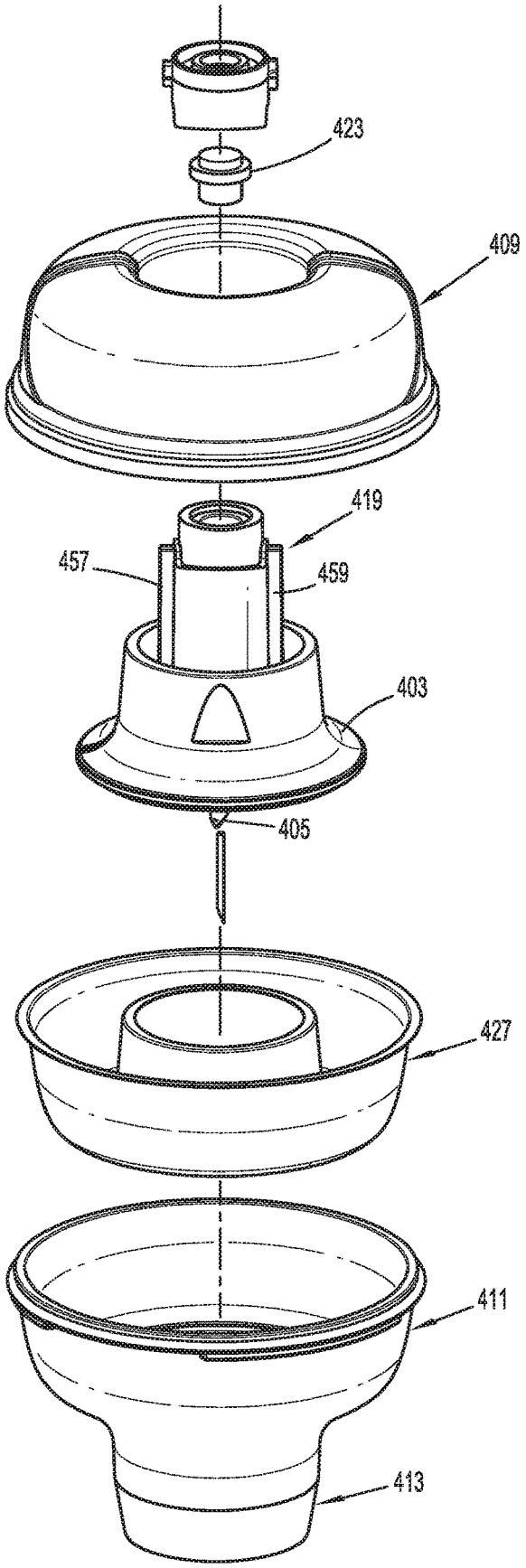
FIG. 21 is a perspective view, with parts separated, of the vial adapter assembly of FIG. 20.
Figure 22:
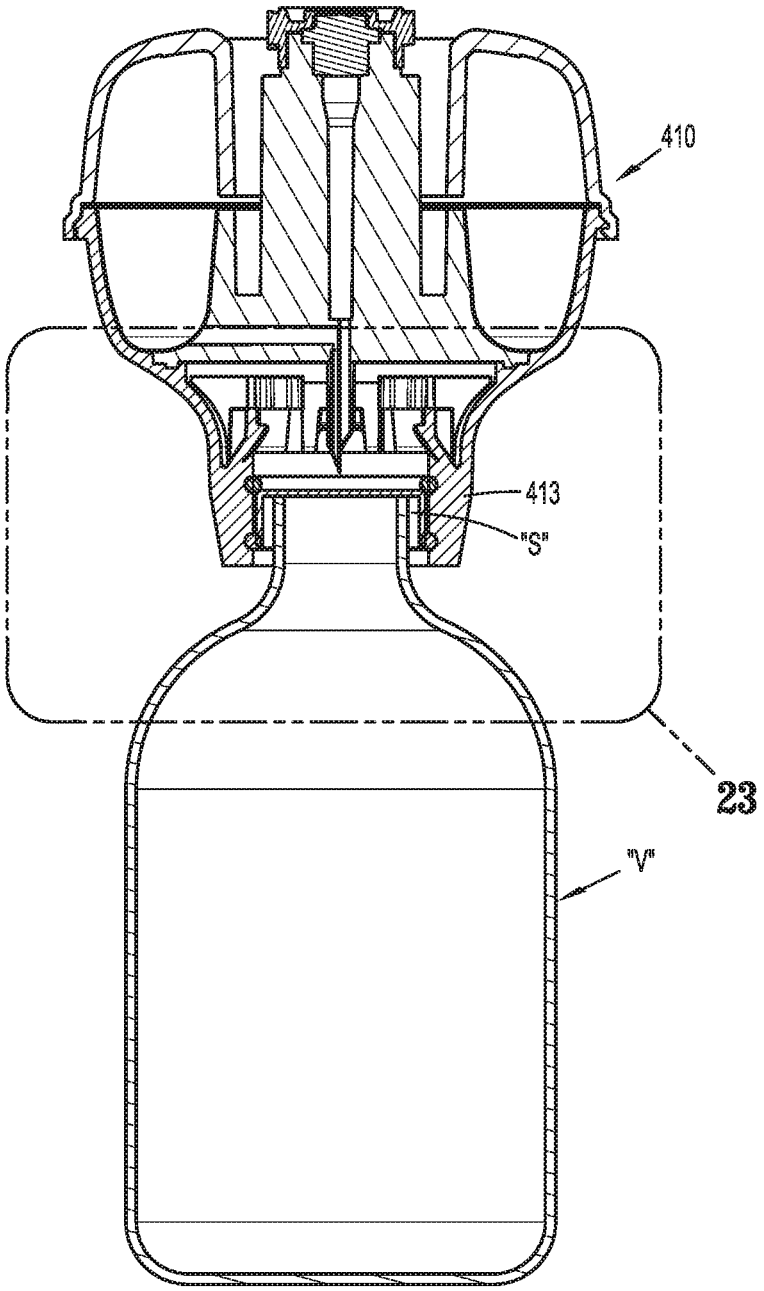
FIG. 22 is a longitudinal, cross-sectional view of the vial adapter assembly and the medical vial of FIG. 20.
Figure 23:
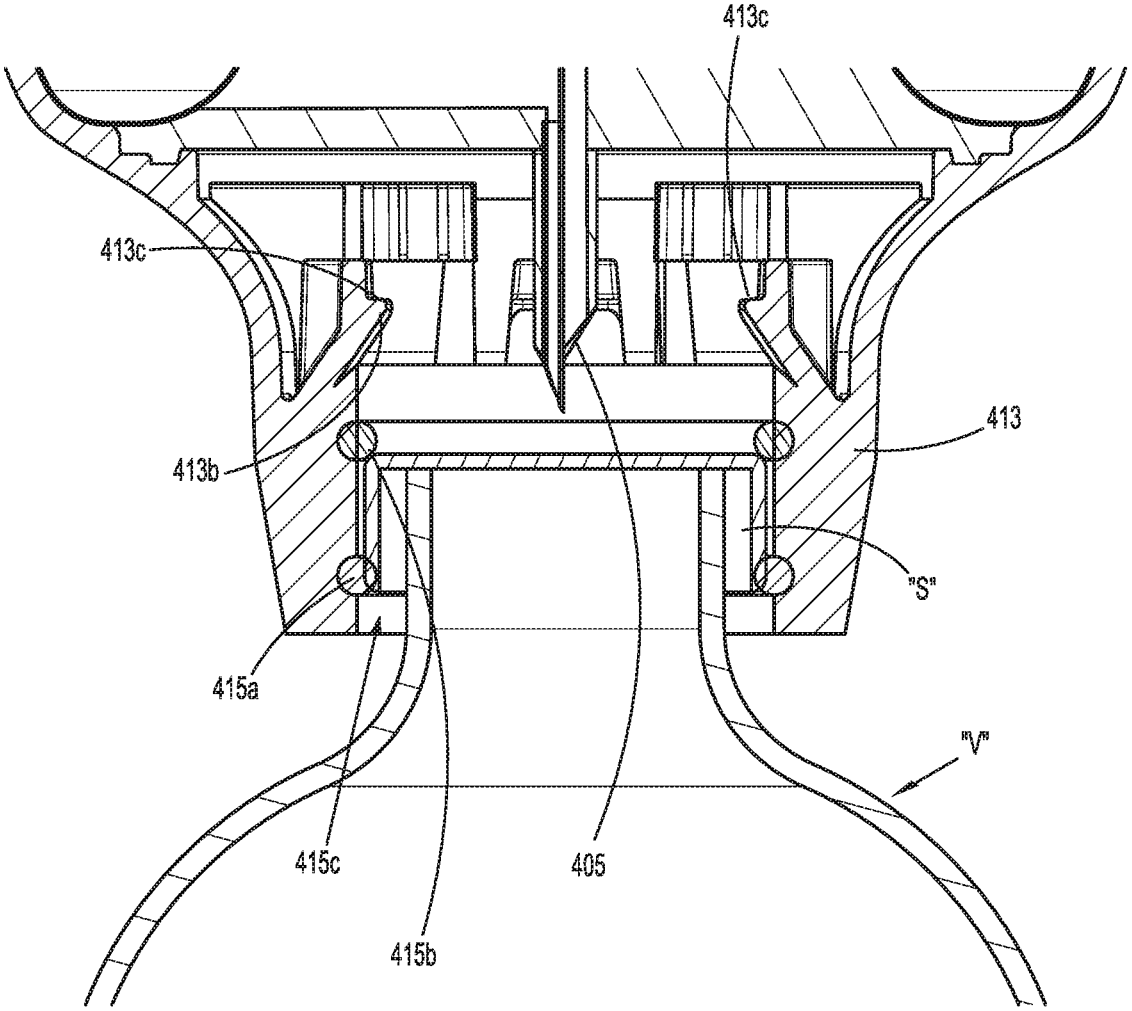
FIG. 23 is an enlarged view of the indicated area of detail of FIG. 22.
Figure 24:
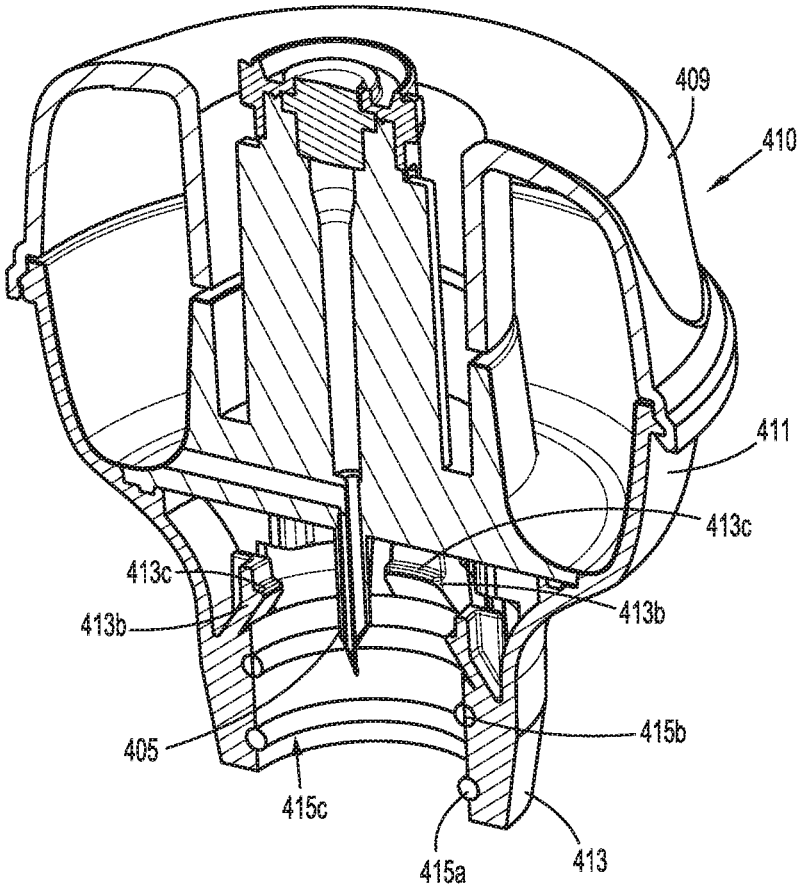
FIG. 24 is a perspective, cross-sectional view of the vial adapter assembly of FIGS. 20-23.

As shown in FIGS. 17-19, proximal end 311 of vial adapter 310 is substantially bowl-shaped and is configured to receive and/or seat adapter support 303 thereon. Vial adapter 310 includes a toroid-shaped expansion chamber 307, including a bladder 327 and translucent distal end or cover 309, seated on an inner rim and an outer rim of proximal end 311. Bladder 327 has a substantially U-shaped radial cross-section including a first annular rim captured between an outer annular rim of proximal end 311 and an outer annular rim of distal end 309 of vial adapter 310, and a second annular rim captured between an inner annular rim of proximal end 311 and an inner annular rim of distal end 309 of vial adapter 310.

Proximal end 311 of vial adapter assembly 300 includes an annular stem 313 extending therefrom. Annular stem 313 defines an opening therein into which a neck of medical vial "V" is received. Annular stem 313 includes at least two pair of proximally extending resilient fingers 314 along a radial length thereof. At least fingers 314 of annular stem 313 are fabricated from polyethylene or polypropylene. Annular stem 313, including fingers 314, may be integrally formed with proximal end 311 or may be a separate component fixedly connected to (e.g., welded, adhered, threaded onto) proximal end 311.

Each finger 314 of annular stem 313 includes a respective proximal-most retainer 314*a* extending radially inwardly therefrom. Proximal-most retainers 314*a* of fingers 314 are configured to connect vial adapter assembly 300 to the neck of medical vial "V" to form a connection, in the first position, between vial adapter assembly 300 and medical vial "V" when the neck of medical vial "V" is inserted into central opening of annular stem 313.

Annular stem 313 also includes at least two pair of distal-most retainer 313*a* extending radially inwardly therefrom. Distal-most retainers 313*a* are disposed distal of proximal-most retainers 314*a*. Distal-most retainers 313*a* of annular stem 313 are configured to connect vial adapter assembly 300 to the neck of medical vial "V" to form a connection, in the second position, between vial adapter assembly 300 and medical vial "V" when vial adapter assembly 300 is actuated from the first position to the second position. Each distal-most retainer 313*a* defines a shoulder or ledge configured to engage the neck of the medical vial "V".

A spike 305 of adapter assembly 300 extends away from proximal end 311 of vial adapter 310 and includes a tip configured to pierce the stopper or septum "S" provided on medical vial "V".

Vial adapter assembly 300 includes a tear-away ring 315 or the like which interconnects fingers 314 of annular stem 313. Tear-away ring 315 functions to inhibit or prevent fingers 314 from splaying radially outward upon an application of a force in a radially outward direction to any one of fingers 314. Tear-away ring 315 may include a tab 315*a* projecting therefrom. Tear-away ring 315 may be integrally formed with, on or in fingers 314 of annular stem 313. Alternatively, a separate ring, band, seal or the like, may be provided which circumscribes or surrounds fingers 314, and which functions to inhibit or prevent fingers 314 from splaying radially outward upon an application of a force in a radially outward direction to any one of fingers 314. Likewise, such alternative separate ring, band, seal or the like, may be selectively removable from fingers 314 to separate fingers 314 and permit fingers 314 to flex or deflect radially outward upon the application of a force in a radially outward direction to any one of fingers 314.

It is contemplated that some fingers 314 may be part of tear-away ring 315 and thus removable upon separation of tear-away ring 315 from annular stem 313. In such an embodiment, an annular channel or groove may be formed around annular stem 313 which functions as a region of reduced strength whereby, when a force is applied to tab 315*a* of tear-away ring 315, tear-away ring 315 is separated, along the annular groove to separate tear-away ring 315 from the remainder of annular stem 313.

In use, tear-away ring 315 may be torn or peeled away from annular stem 313, and in turn, fingers 314, to free fingers 314 and permit fingers 314 to flex or deflect radially outward upon the application of a force in a radially outward direction to any one of fingers 314.

As described above, a medical vial "V" is provided with vial adapter assembly 300 pre-connected, pre-loaded or pre-attached thereto with vial adapter assembly 300 in the first position, wherein spike 305 of vial adapter assembly 300 does not penetrate stopper "S" of medical vial "V". In use, when it is time to access the contents of medical vial "V", tear-away ring 315 is first removed from fingers 314 of annular stem 313, as described above, to separate and free fingers 314. With tear-away ring 315 removed, vial adapter 310 of vial adapter assembly 300 is actuated from the first position to the second position by proximally displacing vial adapter 310 relative to the neck of medical vial "V", as indicated by arrow "A" of FIG. 18. In so doing, fingers 314 flex or deflect radially outward (as indicated by arrow "B" of FIG. 19), as needed, against the outer contour of medical vial "V" until distal-most retainers 313*a* of annular stem 313 of vial adapter 310 are moved into connection with the flange or shoulder of the neck of medical vial "V". Additionally, in so doing, spike 305 of vial adapter 310 is advanced to penetrate stopper "S" of medical vial "V".

Turning now to FIGS. 20-24, vial adapter assembly 400 is shown and described. Vial adapter assembly 400 is substantially similar to vial adapter assembly 100 and thus, will only be described herein in detail to discuss the differences in construction and operation thereof. Vial adapter assembly 400 includes a vial adapter 410 having a distal end or cover 409, and a proximal end or base 411. Vial adapter 410 further includes an adapter support 403 (including a male stem 419 supporting a seal 423 and including opposed, outwardly extending guide rails 457, 459), a spike 405, and an expansion chamber 307.

Distal end 409 of vial adapter 410 is substantially bowl-shaped and is configured to receive and/or seat an adapter support thereon. Vial adapter 410 includes a toroid-shaped expansion chamber including a bladder, and a translucent cover seated on an inner rim and an outer rim of proximal end 411. The bladder has a substantially U-shaped radial cross-section including a first annular rim captured between the outer annular rim of proximal end 411 and the outer annular rim of the cover, and a second annular rim captured between the inner annular rim of proximal end 411 and the inner annular rim of the cover.

As shown in FIGS. 20-22 and 24, proximal end 411 of vial adapter 410 is substantially bowl-shaped and is configured to receive and/or seat adapter support 403 thereon. Vial adapter 410 includes a toroid-shaped expansion chamber 407, including a bladder 427 and translucent distal end or cover 409, seated on an inner rim and an outer rim of proximal end 411. Bladder 427 has a substantially U-shaped radial cross-section including a first annular rim captured between an outer annular rim of proximal end 411 and an outer annular rim of distal end 409 of vial adapter 410, and a second annular rim captured between an inner annular rim of proximal end 411 and an inner annular rim of distal end 409 of vial adapter 410.

Proximal end 411 of vial adapter assembly 400 includes an annular stem 413 extending therefrom. Annular stem 413 defines an opening therein into which a neck of medical vial "V" is received.

Annular stem 413 includes a resilient gasket, skirt, flange or seal 415 extending across a free end thereof or within a radial wall thereof. Gasket 415 may include a proximal gasket 415*a* and a distal gasket 415*b*, with a central opening 415*c* defined in each. Gaskets 415*a*, 415*b* may be fabricated from rubber or a thermoplastic elastomer or the like.

Proximal gasket 415*a* may function as a retainer for retaining vial adapter assembly 400 connected to the neck of medical vial "V" while in the first position. Alternatively, annular stem 413 may include at least two pair of proximal-most retainers extending radially inwardly therefrom. The proximal-most retainers may be configured to connect vial adapter assembly 400 to the neck of medical vial "V" to form a connection, in the first position, between vial adapter assembly 400 and medical vial "V" when the neck of medical vial "V" is inserted into the central opening of annular stem 413.

Annular stem 413 also includes at least two pair of distal-most retainers 413*b* extending radially inwardly therefrom. Distal-most retainers 413*b* are disposed distal of proximal gasket 415*a* and distal gasket 415*b*. Distal-most retainers 413*b* of annular stem 413 are configured to connect vial adapter assembly 400 to the neck of medical vial "V" to form a connection, in the second position, between vial adapter assembly 400 and medical vial "V" when vial adapter assembly 400 is actuated from the first position to the second position. Each distal-most retainer 413*b* includes a shoulder or ledge 413*c* configured to engage the neck of the medical vial "V".

A spike 405 of adapter assembly 400 extends away from proximal end 411 of vial adapter 410 and includes a tip configured to pierce the stopper or septum "S" provided on medical vial "V".

As described above, a medical vial "V" is provided with vial adapter assembly 400 pre-connected, pre-loaded or pre-attached thereto with vial adapter assembly 400 in the first position, wherein spike 405 of vial adapter assembly 400 does not penetrate stopper "S" of medical vial "V". When vial adapter assembly 400 is in the first position, the neck of the medical vial "V" extends through central opening 415*c* of gasket 415 wherein proximal gasket 415*a* forms a seal about the neck of the medical vial "V" and functions to help secure vial adapter assembly 400 to medical vial "V".

In use, vial adapter 410 of vial adapter assembly 400 is actuated from the first position to the second position by proximally displacing vial adapter 410 relative to the neck of medical vial "V". In so doing, spike 405 of vial adapter 410 is advanced to penetrate stopper "S" of medical vial "V". When vial adapter assembly 400 is in the second position, distal gasket 415*b* may function to form a seal about the neck of the medical vial "V".

For a more detailed discussion of the construction and operation of certain aspects, component and features of vial adapters 110, 210, 310 and 410, reference may be made to U.S. Pat. No. 9,107,809, the entire content of which is incorporated herein by reference.

It will be understood that various modifications may be made to the embodiments disclosed herein. Therefore, the above description should not be construed as limiting, but merely as exemplifications of preferred embodiments. Those skilled in the art will envision other modifications within the scope and spirit of the claims appended thereto.

What is claimed is:

1. A vial adapter assembly for a closed fluid transfer system, the vial adapter assembly comprising:

a vial adapter, including:

a base defining an inner annular rim and an outer annular rim and a cavity therebetween;

an annular stem extending from the base and defining an opening having a plurality of fingers extending around the opening thereof, wherein each finger defines a proximal recess and a distal recess formed therein;

a cover supported on the outer annular rim, wherein an expansion chamber is defined within the cover and the base;

an adapter support situated within the cavity of the base, the adapter support including:

a male stem extending in a first direction from the base, the male stem selectively connectable to and insertable into an open distal end of a syringe adapter, the male stem defining a lumen extending therethrough;

a seal extending across the lumen of the male stem; and a spike extending in a second direction from the inner annular rim and into the opening of the annular stem, wherein the spike includes a first lumen being in fluid communication with the lumen of the male stem, and wherein the spike includes a second lumen being in fluid communication with the expansion chamber; and a bladder extending between the base and the cover; and a vial collar including:

an annular body configured and dimensioned for sliding receipt within the annular stem of the vial adapter;

at least one tab projecting from an outer surface of the annular body and being configured for selective receipt in distal recess and proximal recess of a respective finger of the vial adapter; and at least one retainer projecting from an inner surface of the annular body.

2. The vial adapter assembly according to claim 1, wherein the vial adapter assembly includes a first position where the vial collar is extended relative to the annular stem, and a second position where the vial collar is retracted relative to the annular stem.

3. The vial adapter assembly according to claim 2, wherein when the vial adapter assembly is in the first position, the at least one tab of the vial collar is disposed within the distal recess of a respective finger of the plurality of fingers of the annular stem.

4. The vial adapter assembly according to claim 3, wherein when the vial adapter assembly is in the second position, the at least one tab of the vial collar is disposed within the proximal recess of a respective finger of the plurality of fingers of the annular stem.

5. The vial adapter assembly according to claim 4, wherein the plurality of fingers of the annular stem of the vial adapter includes two pair of diametrically opposed fingers.

6. The vial adapter assembly according to claim 5, wherein the at least one tab of the vial collar includes two pair of diametrically opposed tabs.

7. The vial adapter assembly according to claim 6, wherein the at least one retainer of the vial adapter includes two pair of diametrically opposed retainers.

8. The vial adapter assembly according to claim 4, wherein the plurality of fingers of the annular stem are resilient.

9. The vial adapter assembly according to claim 8, wherein the spike of the vial adapter extends towards the annular body of the vial collar.

10. The vial adapter assembly according to claim 4, wherein the spike of the vial adapter is configured to penetrate a stopper of a medical vial upon an actuation of the vial adapter assembly from the first position to the second position.

11. The vial adapter assembly according to claim 2, wherein when the vial adapter assembly is in the second position, the at least one tab of the vial collar is disposed within the proximal recess of a respective finger of the plurality of fingers of the annular stem.

* * * * *